US007921792B2

(12) United States Patent
Lemonides

(10) Patent No.: US 7,921,792 B2
(45) Date of Patent: Apr. 12, 2011

(54) APPARATUS FOR AFFIXING A DOCK TO AN INBOARD MOORING POLE

(76) Inventor: Dimitri Lemonides, Oceanside, NY (US)

( * ) Notice: Subject to any disclaimer, the term of this patent is extended or adjusted under 35 U.S.C. 154(b) by 123 days.

(21) Appl. No.: 12/316,293

(22) Filed: Dec. 11, 2008

(65) Prior Publication Data

US 2009/0090289 A1 Apr. 9, 2009

Related U.S. Application Data

(63) Continuation-in-part of application No. 11/699,181, filed on Jan. 29, 2007, now Pat. No. 7,464,659, which is a continuation-in-part of application No. 11/026,791, filed on Dec. 31, 2004, now Pat. No. 7,188,579.

(51) Int. Cl.
*B63B 21/00* (2006.01)

(52) U.S. Cl. ..... 114/230.1

(58) Field of Classification Search ..... 114/263, 114/230.1; 405/219, 221
See application file for complete search history.

(56) References Cited

U.S. PATENT DOCUMENTS 3,486,342 A * 12/1969 Aks ..... 405/212
3,997,150 A * 12/1976 Hanson et al. ..... 267/140
4,286,897 A * 9/1981 Suskind ..... 405/221
4,357,891 A * 11/1982 Sluys ..... 114/230.27
4,923,336 A * 5/1990 Schmidt ..... 405/216
5,937,781 A * 8/1999 Isella et al. ..... 114/230.26
7,153,064 B2 * 12/2006 Zeilinger et al. ..... 405/221
7,188,579 B2 * 3/2007 Lemonides ..... 114/230.2
7,464,659 B2 * 12/2008 Lemonides ..... 114/263

* cited by examiner

*Primary Examiner* — Daniel V Venne
(74) *Attorney, Agent, or Firm* — Richard L. Strauss, Esq.

(57) ABSTRACT

An apparatus is disclosed especially configured and adapted for mooring a floating dock to an inboard mooring pile—a pile positioned within and extending through the top deck of a floating dock—. The apparatus minimizes damage to both dock and mooring piles caused by changes in tide, waves, wake and other water disturbances while, simultaneously, adding stability to the floating dock—especially in regarding to listing—. The apparatus is comprised of a cylindrical sleeve which is coaxially applied to a mooring pile, a dock mounted mooring bracket comprised of a base plate which connects to the sleeve mounted upon the pile via at least one "U" shaped arm. The arm, in turn, extends, and is mounted upon a vertical planar portion of the base plate and is disposed in a parallel relation to the top surface of the floating dock. An inner, semi-circular portion of the "U" shaped arm engages selected and parallel circumferential grooves formed in the outer surface of the sleeve. The base plate, in turn, is affixed to a structurally sound portion of the floating dock adjacent to a pile aperture through which the mooring pile extends. In certain alternate preferred embodiments, an elongated rod is utilized to firmly engage a selected circumferential groove of the columnar sleeve. In such embodiments, the elongated rod is mounted to the floating via a mounting means at both termini of the elongated rod. Embodiments utilizing elongated rods for engagement of the columnar sleeve utilize at least two such rods and engage the columnar sleeve on opposite sides thereof.

29 Claims, 9 Drawing Sheets

APPARATUS FOR AFFIXING A DOCK TO AN INBOARD MOORING POLE

This application is a continuation-in-part of U.S. patent application Ser. No. 11/699,181 filed Jan. 29, 2007 now U.S. Pat. No. 7,464,659 which, in turn, is a continuation-in-part of U.S. patent application Ser. No. 11/026,791 filed Dec. 31, 2004 now U.S. Pat. No. 7,188,579, the entire specification of each said applications is hereby incorporated herein by reference.

TECHNICAL FIELD

The device and method disclosed herein relate generally to marine mooring systems. More specifically, the disclosed device and method of use thereof relates to enhanced utilization of mooring poles for securing floating docks.

BACKGROUND OF THE ART

It is well known that the mooring floating docks (and attachments thereto such as "fingers") to pilings is often complicated by changing tides. In some areas, such changes in tides—from low tide to high tide—may be so great as to cause great stress, friction and wear to both floating docks and the mooring poles which hold such docks in place. For example, a dock may be moored to one or more mooring piles utilizing chains, chain covered by PVC pipe segments or metal brackets. As tide levels cycle throughout the day, both dock and pile are subjected to wear and damage caused by the movement of each relative to the other. In addition, waves, wake and other water disturbances may cause additional damage to both pilings and docks by virtue of the impacts suffered therebetween. In addition, a floating dock secured to a mooring post may become dangerously tilted, damaged and/or capsized during tide changes if the means of securing the dock to the pile(s) does not allow for vertical movement along the pile(s) during such tide changes.

In regard to damage caused by movement between floating dock and mooring piles, such docks may be equipped with rubber molding, bumpers or other resilient materials designed to reduce such damage. However, the incessant changes in tide coupled with the action of waves and wakes, over time, will almost certainly cause the loss of such protective devices. Although such moldings and bumpers may be replaced, constant vigilance and maintenance is required due to the inherent deficiencies of such devices.

Floating docks are commonly constructed about a core of flotation material such as, for example, a foam material. With time, portions of such foam may break away, become saturated with water, or otherwise loose the buoyancy otherwise provided to the dock structure they support. As floatation material is either lost or damaged, the stability of the floating dock decreases thereby allowing the structure to list from one side to the other as weight, such as passengers entering into a boat, is applied to sides (and away from the midline) of such docks.

Even in regard to new docks, incorporating perfectly performing and placed buoyancy materials, listing does occur when substantial weight is applied along one side of the floating dock. Such listing also occurs, even in regard to docks whose total composition provides floatation (and which do not require separate floatation materials). Listing of floating docks can be dangerous in regards to the safety of passengers embarking and disembarking boats tied to such docks. In addition, equipment, food and other provisions placed in the vicinity of the edge of the dock may be lost during such listing.

U.S. patent application Ser. No. 11/026,791 (the "791 APPLICATION") discloses a mooring pole line attachment device providing safe mooring of a boat or other marine vehicle to a mooring pole by continually adjusting the height of line attachment points thereupon with changes in water level. In addition, the mooring pole line attachment device disclosed in the '791 application provides protection of mooring poles from rough contacts with boats moored thereto, while simultaneously affording protection to the boats. The mooring pole line attachment device is comprised of a buoyant base, cylindrical sleeve and at least one line engagement means.

The buoyant base is tubular in configuration and includes an outer surface and an internal core surrounding and defining a central bore. The core of the buoyant base includes an inner circumferential coiled tube (similar to the columnar sleeve, but of a more diminutive diameter. The coiled tube within the base includes an outer surface which is configured to demonstrate parallel grooves and rings similar to that found upon the outer surface of the cylindrical sleeve. The coiled tube is positioned and aligned to lie circumferentially about the proximal (or inferior) termini of the cylindrical sleeve. The coiled tube defines a central bore of a dimension sufficient so as to allow the sleeve—as discussed immediately above—to fit therewithin, substantially flush with the proximal (inferior) terminus thereof. Thus, the parallel rings and grooves formed on the surface of the buoyant base are aligned generally perpendicular to the parallel rings and grooves of the cylindrical sleeve. The outer surface of the buoyant base is advantageously covered by a tough, resilient cover, such as, for example, a polyvinyl, polyester or nylon composition. The cover may be fabricated of one or more sections and tied (or otherwise affixed) to the outer surface of the buoyant base. The inner core of the buoyant base is comprised of a buoyant structure such as, for example, a circumferential polyethylene, polyvinyl or polyester hollow tube positioned within the core. Additionally, the core of the buoyant base is filled with a buoyant material such as, for example, a polystyrene foam thereby imparting great buoyancy to the base.

As mentioned above, the buoyant base defines a substantially tubular, or, as it may be better described, a "donut-like" shape including an inner bore. The inner bore of the buoyant base is affixed to a proximal terminus of the cylindrical sleeve of the device. The cylindrical sleeve is comprised of a hollow tubular structure with an outer surface and an inner surface defining a central bore. The outer surface of the cylindrical sleeve is shaped and configured to include a plurality of continuous parallel grooves arranged circumferentially about said outer surface. In contrast, the inner surface of the cylindrical sleeve defines a relatively smooth surface. The cylindrical sleeve may be fabricated of any marine quality material such as, for example, a polyvinyl, polyether or polyester plastic. The sleeve may be also fabricated from a natural rubber or a synthetic rubber such as, for example, a nitrile rubber. The cylindrical sleeve includes a proximal and distal terminus. The proximal terminus of the sleeve and the inner bore of the buoyant base are especially configured so that the outer surface of the columnar sleeve will mate with the central bore of the base thereby allowing ease of fixation of the base to the proximal terminus of the tube via, for example injection and curing of the above-described polystyrene core material into the base during fabrication of the device (discussed in greater detail below).

The smooth inner surface of the cylindrical sleeve (and the central bore defined thereby) are especially sized and configured so as to allow the device (with cylinder attached to base) to slide easily over a mooring pole. The smooth inner surface of the cylindrical sleeve runs from the proximal (or inferior) to the distal (or superior) terminus of the device thereby allowing the entire device to be placed upon and slide up and down a mooring pole.

The annular (or parallel circumferential) grooves of the cylindrical sleeve serves two distinct purposes. During the fabrication of the mooring pole device, the outer surface of the sleeve is passed through the buoyant base section prior to injection of foam therein. At this point in the fabrication process, the buoyant base includes the above-described outer cover, an inner circumferential coiled tube (similar to the columnar sleeve, but of a more diminutive diameter). The coiled tube within the base defines a central bore of a dimension sufficient so as to allow the sleeve to fit therewithin, substantially flush with the proximal (inferior) terminus thereof. Thereafter, polystyrene (or other suitable buoyant) foam is injected into the base an fills both the base and the outer annular rings of the sleeve thereby effectively affixing one to the other. Thus the central bore of the sleeve becomes the central bore of the entire device.

The annular rings of the sleeve also provide line tied points of varying heights (in regard to water level) so as to accommodate boats of varying sizes and freeboard dimension. For example, and as shown in greater detail below, the device of the present invention may include a line engagement means comprised of an adjustable rope tied circumferentially about a selected annular groove. The adjustable rope is configure to include one or more loops through which mooring lines may be past in order to secure a boat. The adjustable rope is tied so as to allow it to be moved superiorly or inferiorly along the outer sleeve so as to accommodate the afore-mentioned varying boat dimensions.

The device disclosed in the '791 application may optionally include a mooring line storage device such as, for example, a simple velcro or snap lock nylon strap affixed near the superior portion of the device so as to allow mooring lines to be left high and dry at the pole.

The device disclosed in the '791 application is prepared for use as follows. The device is slid down upon a mooring pole, the central bore of the device being configured to fit about such a pole. Upon contact of the buoyant base with water surrounding the pole, the device begins to float. Thereafter, an annular ring is selected for placement of the afore-mentioned adjustable rope. Thereafter a mooring line may be attached to the adjustable rope. As the tide level changes, the device rises and lowers to accommodate such changes. However, the relative vertical positions of the annular ring (tie point) of the present device, and the position of a boats engaged cleats will not change. Therefore, changes in tides will not result in any stress or strain on mooring lines, boats or pilings. In addition, the cylindrical sleeve is highly efficient at protecting both boat and piling from collisions therebetween due to the fact that the sleeve circumferentially covers the pole and rises and falls with changing tides.

U.S. patent application Ser. No. 11/699,181 discloses an apparatus for affixing a floating dock to a mooring pile wherein the mooring pile is described as located adjacent to the floating dock. However, utilizing outboard (piles located adjacent to a floating dock) rather than inboard (piles located within the confines and protruding through a floating dock) has certain inherent disadvantages. Firstly, outboard piles, being located adjacent to a floating dock, pose a partial obstruction to boats moored to the side of the dock where the mooring pile is located. Secondly, such outboard piles are exposed to direct collision with boats and other objects within the water surrounding the dock. It has been known to utilize mooring piles located within the confines of a floating dock as a means of anchoring such docks. In such instances, a portion of the top decking of the dock is typically "boxed out" to form a reinforced opening through which a pile extends from beneath the water bed underlying a body of water wherein it is set, upward, and through the opening within the confines of the floating dock. In such instances, the boxed out opening may be lined with a resilient material so as to cushion impact between the side of such inboard mooring piles and the boxed out opening of the deck so as to reduce the damage to both pile and deck caused by such collisions caused, in turn, by listing of the dock. Such known inboard pile systems do not provide any substantial reduction in dock listing since adequate clearance must be provided between the sides of the pile protruding through the dock and the surrounding surfaces of the dock adjacent to the pile. Close adaptation of an inboard pile to an opening within the dock deck would most probably result in destruction of the decking and/or pile during listing of the dock due to the leverage of the decking against the pile during such listing. What is needed is a means of affixing a mooring pile, located inboard (within the confines rather than adjacent to) in relation to a floating dock, wherein collisions and related damage to both pile and dock are minimized while, at the same time, imparting increased stability thereto.

SUMMARY OF THE INVENTION

Now in accordance with the present invention, an apparatus is disclosed for affixing a floating dock to a mooring pile wherein such pile is located within the confines of the floating dock. The apparatus is especially configured and adapted to minimize damage to both dock and mooring piles caused by changes in tide, waves, wake and other water disturbances while, simultaneously, adding stability to the floating dock. The apparatus of the present invention is comprised of a cylindrical sleeve, a mooring brackets and a means for affixing the mooring bracket to a floating dock. As described in greater detail below, the apparatus of the present invention provides a secure means for mooring a floating dock to one or more pilings located inboard—within the confines (or within the perimeter)—of a floating dock. The apparatus of the present invention greatly minimizes damage to both floating docks and pilings caused by the aforementioned water disturbances and changes in water level. The apparatus also increases the stability of the dock in regard to listing (associated with wave action or uneven application of weight, as discussed above).

The cylindrical sleeve of the present invention is a tubular structure having an outer surface, an inner surface, proximal (inferior) and distal (superior) termini. The sleeve is configured to include a central bore therewithin extending throughout the length of the sleeve. The central bore is especially configured to demonstrate a diameter especially selected to allow the bore to receive (and the sleeve to be place coaxially upon) a piling having a given outside diameter and length. The selected bore diameter allows the sleeve, as described in more detail, below, to move up an down along the length of the piling—without binding—while, at the same time, is selected to closely adapt to the piling in order to minimize lateral movement of the sleeve when placed coaxially upon such a piling. However, sufficient clearance must be provided for movement—without interference—of the sleeve along the length of the pile. Such a configuration allows the cylindrical sleeves, as discussed above and below, to be coaxially slipped over a mooring pile anchored in the sea (water) bed beneath, and extending through the top surface of a floating dock.

The outer (or outside) surface of the cylindrical sleeve is configured to include a plurality of circumferential parallel rings and grooves. Thus, the circumferential parallel rings and grooves are oriented perpendicular to the long axis of the sleeve. It is especially advantageous to configure the cylindrical sleeves with cylindrical parallel grooves running along the entire length of the cylindrical sleeve. In contrast to the outside surface, the inner surface of the cylindrical sleeve (defining the central bore), exhibits a smooth surface to facilitate movement along the length of a mooring pile. The cylindrical sleeve may be fabricated of any marine quality material such as, for example, a polyvinyl, polyether or polyester plastic. The sleeve may be also fabricated from a natural rubber or a synthetic rubber such as, for example, a nitrile rubber.

In certain preferred embodiments of the present invention the apparatus further comprises a buoyant base (disclosed in more detail below) affixed to the cylindrical sleeve. In such embodiments, the outside diameter of the sleeve and the diameter of the inner bore of the buoyant base are especially configured so that a proximal portion of the outer surface of the cylindrical sleeve will fit coaxially within and mate with the central bore of the buoyant base. Such a configuration allows ease of fixation of the buoyant base to the proximal terminus of the cylindrical tube via, for example, injection and curing of polystyrene core material into the base during fabrication of the device (discussed in greater detail above and below). However, the buoyant base may be secured to the cylindrical sleeve by any suitable and effective means such as, but not limited to bonding, metal/nylon fasteners or fabricating the buoyant base and cylindrical sleeve as one contiguous structure. The buoyant base includes sufficient buoyant material therewithin so as to enable all of the cylindrical sleeve, disposed superior (or distal) to the superior terminus of the buoyant base to lie above the water line when the apparatus is coaxially applied to a mooring pile. Such buoyancy is of great assistance in assuring that all of the parallel circumferential grooves, superior (distal) to the superior (distal) terminus of the buoyant base will be available for positioning of the below described "U" shaped arms and elongated rods.

As also described in greater detail, below, embodiments of the present invention incorporating the afore-mentioned buoyant base may, via the buoyancy provided by the buoyant base of the present apparatus, provide a means of enhancing the buoyancy of a floating dock to which the apparatus is affixed. In other embodiments, wherein a floating dock may not incorporate any, or sufficient floatation material to enable the dock to float, the buoyancy provided by the buoyant base alone is utilized to provide floatation to the dock.

As discussed above, the smooth inner surface of the cylindrical sleeve (and the central bore defined thereby) are especially sized and configured so as to allow the device (with or without the cylinder attached to a buoyant base) to closely a adapt to, yet still slide easily over a mooring pole. The smooth inner surface of the cylindrical sleeve runs from the proximal (or inferior) to the distal (or superior) terminus of the device thereby allowing the entire device to be placed upon and slide coaxially, along the length of a mooring pole. It is preferred that, in order to achieve such close adaptation of sleeve to pile, that the inside diameter of the cylindrical sleeve be from about 1.0 inches to about 4 inches larger than the outside diameter of a pile to which it is applied. It is still further preferred that the inside diameter of the cylindrical sleeve be from about 1.5 inches to about 3 inches larger than the outside diameter of the cylindrical sleeve.

The circumferential parallel grooves formed upon the external surface of the cylindrical sleeve serve two purposes. Firstly, the grooves form engagement sites for receipt of the "U" shaped arms or elongated rods (discussed below) of the floating dock mooring bracket (discussed in detail below). Secondly, the rings and grooves also provide points for attachment of mooring lines to boats moored alongside a floating dock utilizing mooring piles upon which the apparatus of the present invention is placed for mooring of the floating dock (rather than tying such boats to the floating dock). The parallel grooves and grooves are, of course, parallel in configuration to each other and are aligned perpendicular to the long axis of the sleeve. As mentioned above, the inner bore of the cylindrical sleeve is selected to closely adapt to a pile upon which it is placed. As discussed below, the "U" shaped arms and elongated rods are similarly disposed perpendicular to the vertical portion of the mooring bracket to which they are affixed, are parallel to one another, and are spaced apart (as discussed below), when the apparatus of the present invention is affixed to a floating dock. This configuration of fit and parallelism allows a dock—moored to a piling by the apparatus—to rise and fall with changing tide levels while simultaneously resisting listing movements of the dock in reaction to water currents, wake and other disturbances.

In a preferred embodiment of the present invention, the floating dock mooring bracket is comprised of a base plate, each including at least one "U" shaped arm depending therefrom, a means of affixing the arms to the base plate and a means of affixing the base plate to a floating dock. It is preferred that the base plate be fabricated of a corrosion resistant or non-corroding metal such as, for example, galvanized steel, aluminum or stainless steel. However, it is also contemplated that the base plate may be fabricated of a metal protected against corrosion (oxidation) via a corrosion resistant finish such as, for example, a powder coat paint. It is also contemplated that a high strength composite material such as, for example, a filled plastic resin, fiberglass or carbon fiber composite material may be utilized to form the plate.

In preferred embodiments of the present invention, the base plate may be described as defining an "L" shaped bracket having a vertical section and a horizontal section. (Other alternate preferred embodiments of the present invention utilized a flat base plate, described in detail, below) The vertical and horizontal sections of the base plate are comprised of flat, planar surfaces disposed at 90 degrees to one another.

The vertical section of the "U" shaped base plate may be described as having an inside face and an outside face while the horizontal section includes a top and bottom surface. The outer face of the vertical section of the base plate is that surface which, when the base plate is mounted upon a top surface of a floating dock (as described below) is oriented towards and adjacent to the outer surface of a cylindrical sleeve to which it is engaged. More specifically, and as described in more detail, below, the "U" shaped arms pass about the cylindrical sleeve, within a circumferential groove therewithin, and thereafter passes through receiving bores placed within the vertical section of the base plate which serve to horizontally align the "U" shaped arm with the circumferential groove in which it is placed. Terminal portions of the "U" shaped arms may be advantageously configured to include external threading which are especially shaped, sized and machined to matingly engage by washers and nuts applied to the termini and tightened against both the outer (facing the pile) and the inner face (facing away from the pile) face of the vertical portion of the "L" shaped plate.

Regardless of the means of affixing the "U" shaped arms to the plate, in preferred embodiments of the present invention, the "U" shaped arms are disposed in a perpendicular manner to the vertical portion of the base plate and the arms are parallel to one another, and are spaced apart. This configuration—in combination with the close adaptation of the sleeve to the piling and the parallel grooves provided on the surface of the sleeve, as discussed above, enhances the ability of the apparatus to provide stability to a floating dock against listing.

The bottom surface of the horizontal section of the base plate is that surface of the plate mounted upon and in contact with the top decking a floating dock adjacent to the boxed out area of the dock through which the pile, with coaxially place cylindrical sleeve thereupon, protrudes. The term "boxed out opening" refers to the opening, within the confines of the top portion (or decking) of a floating dock, which is ordinarily reinforced so as to tie together ends of decking (or planks) which have been cut to create an opening through which an inboard pile is intended to protrude. The opening in the top surface of a floating dock through which a mooring pile extends is also referred to herein as the "pile aperture". The top surface of the horizontal portion of the base plate faces upward, away from the decking upon which the base plate is mounted. It is highly advantageous to anchor the base plate to the decking about the opening through which an inboard pile protrudes by utilizing bolts and/or screws, which are passed through bores communicating through the top and bottom surface of the horizontal portion of the base plate so as to engage the decking therebelow.

It is preferred, but not required, that each of the base plates be affixed to the cylindrical sleeve via at least two "U" shaped arms. At minimum, the present invention requires a base plate upon which at least one "U" shaped arm is affixed in order to engage a selected circumferential groove of a cylindrical sleeve mounted about a pile. The base plate, in turn is affixed to the floating dock adjacent to the pile aperture through which a pile, upon which the circumferential sleeve is placed. It is preferred that the "U" shaped arms be fabricated of a corrosion resistant or non-corroding metal such as, for example, galvanized steel, aluminum or stainless steel.

As mentioned above, the base plate may be advantageously configured as an "L" shaped plate having a vertical and horizontal portion. It is preferred that the vertical and horizontal portions may be configured as a square or rectangular plate (having a relatively flat profile) fabricated of any of the above-mentioned materials. However, the base plate may also be formed in other shapes in order to allow the plate to be securely affixed to the decking about the opening in the deck through which a mooring pile extends so long as the plate is configured to enable firm engagement of the dock and horizontal and parallel affixation of the "U" shaped arms to the circumferential grooves of the cylindrical sleeve coaxially placed on an inboard mooring pile. As mentioned above and below, the present invention also contemplates the use of flat, rather than "L" shaped base plates which are mounted upon, and, in some cases, form walls of the pile aperture.

In certain preferred embodiments of the present invention, the vertical portion of the base plate includes at least two pairs of "U" shaped arm receiving holes provided as a means of mounting at least two "U" shaped arms (discussed below), to the base plate. However, the base plate may include only a single pair of "U" shaped receiving holes or may include additional pairs of "U" shaped arm receiving holes in order to provide greater flexibility in selection of bracket mounting positions and/or the use of one, two or more "U" shaped arms depending from the base plate.

The horizontal portion of the base plate is configured to include at least two and preferably four anchor bolt receiving holes passing therethrough for receipt of anchor bolts, anchor screws or other fastening devices utilized as the means of affixing the base plate to the top surface of a floating dock (as discussed in more detail, below). It is preferred that these affixing means also be fabricated from a corrosion resistant metal such as, for example, galvanized steel, brass or stainless steel. Also, the horizontal portion of the "L" shaped base plate may be affixed to a floating dock via bonding or welding depending upon the material utilized to form the top surface and/or other structural portions of the dock adjacent to the pile aperture.

Regardless of the number of pairs of receiving holes prepared within the vertical section of the "L" shaped base plate, each pair must be prepared so that the "U" shaped arms affixed to the plate therethrough will be disposed parallel to one another as well as substantially parallel to the top surface of the dock to which they are affixed and the water in which the floating dock is moored. Thus the "U" shaped arm receiving holes must be prepared so that a line drawn between the center of any pair of "U" shaped arm receiving holes and a line drawn between the center of any other pair of such "U" shaped arm receiving holes are parallel to one another. Also, when the plate is affixed to a dock, these lines will be parallel to the top surface of the dock and substantially parallel to the surface of the water in which the dock is moored. Thus, "U" shaped arms affixed to the base plate which, in turn, is affixed to a dock will be disposed parallel to one another, the top surface of the dock (substantially parallel to the surface of the water). The arms will also be disposed in a parallel relation to the circumferential grooves of a cylindrical sleeve of the present invention placed upon a piling. It is highly preferable that the piling to which the bracket is affixed is set within and anchored to the earth underlying the body of water in which the floating dock is to be moored in a plumb manner.

The aforementioned parallel arrangement of the top surface of the dock, each pair of "U" shaped arm receiving holes, "U" shaped arms and the circumferential grooves of the cylindrical sleeve enhances the ability of the sleeve to move up and down along a piling upon which it is placed during changes in tide level—without binding—while also resisting listing of the dock which the apparatus moores. The aforementioned parallel relation of the "U" shaped arms is achieved in preferred embodiments of the present invention regardless of the manner (e.g. nuts/washers, bolts, welding, bonding or integral fabrication) in which the "U" shaped arms are affixed to the vertical portion of the plate.

As discussed above, it is highly advantageous, although not essential, that each of the mooring bracket includes and is adapted to receive at least two "U" shaped arms especially configured and adapted to engage at least two circumferential parallel grooves of the cylindrical sleeve. In such embodiments, at least two "U" shaped arms are configured, arranged and mounted upon the vertical portion of the base plate in such a manner as to enable engagement of two adjacent parallel grooves of the cylindrical sleeve. However, the present invention contemplates embodiments wherein the at least two "U" shaped arms are configured, arranged and mounted upon the base plate in such a manner as to engage parallel, but non-adjacent parallel grooves as well (wherein interceding grooves of the cylindrical sleeve intervene between grooves engaged by the "U" shaped arms.

For example, the present invention contemplates placement of two base plates located facing an opposite to each other on either side of the opening through which a mooring pile extends through the top deck of a floating dock. In certain preferred embodiments of the present invention, one "U" shaped arm extends from the vertical section of each of the base plates so as to engage, for example, circumferential grooves of the cylindrical sleeve which are not adjacent, but rather are spaced apart, one from the other. Such an arrangement results in opposing "U" shaped arms engaging the sleeve from opposite directions, but on a parallel plane to one another. By engaging non-adjacent horizontal grooves of the cylindrical sleeve, the vertical distance between the arms increases and, accordingly, more stability is provided to the dock. Alternatively, two "U" shaped arms may extend from each of the vertical sections of the two base plates. In such an arrangement, it may be advantageous to engage, for example, a superior (higher) horizontal groove with the uppermost "U" shaped arm extending from the first bracket, and thereafter, engage the next (adjacent) groove inferior to the first with the superior "U" shaped arm extending from the second bracket. Thereafter, the next inferior groove is engaged by the remaining (and inferior positioned) "U" shaped arm extending from the first bracket. Finally, the next inferior groove of the cylindrical sleeve is engaged by the inferior most "U" shaped arm extending from the second bracket. This alternating engagement—in which each arm is parallel to one another, parallel to the top surface of the dock, and perpendicular to the long axis of the mooring pile, is highly stabilizing to the dock in regard to listing—but is not required in order to practice the present invention—. The present invention also contemplates utilizing, in addition to one, two, three, four or more bracket configurations wherein each bracket engages the cylindrical sleeve coaxially placed in the inboard mooring pile via at least one "U" shaped arm.

The "U" shaped arms may be described as terminating with two terminal ends (or termini), and include, at a portion of the arms therebetween, a curved "semi-circular" portion. The curved "semi-circular" portion is configured to demonstrate an inside diameter configured to closely adapt to an enable the arm to tightly engage a selected circumferential groove located on the sleeve. In certain preferred embodiments of the present invention, the termini of the "U" shaped arms are externally threaded as a means for engagement receiving bores formed in the vertical portion of the base plate via nuts and washers. However, it is also contemplated, in other preferred embodiments of the present invention, that the termini of the "U" shaped arms are affixed directly to the base plate via bonding, welding or one-piece construction wherein the "U" shaped arms and base plate are fabricated as one continuous unit.

As discussed above, the "U" shaped arms are affixed to the base plate in such a manner and in such an orientation as to enable the "U" shaped arms on two or more base plates to engage both adjacent and non-adjacent circumferential parallel grooves of the cylindrical sleeve, as desired. Thus, the "U" shaped arms are mounted, upon the base, in such a manner as to position the "U" shaped arms parallel other "U" shaped arms extending therefrom and also parallel to "U" shaped arms extending from any other base plate mounted upon the top surface of the floating dock. In preferred embodiments of the present invention, the intervening space between "U" shaped arms extending from a given base plate will be substantially equal to the space between two adjacent parallel grooves or, in other embodiments, the space between non-adjacent parallel grooves engaged by the "U" shaped arms.

The "U" shaped arms are formed to demonstrate an inside diameter, that allows the "U" shaped arms to closely adapt to, engage and lie within the parallel grooves of the cylindrical sleeve. As discussed below, the close adaptation of the "U" shaped arms within the grooves of the cylindrical sleeve enables the apparatus of the present invention to provide great stability to a dock utilizing such apparatus for mooring as against listing in reaction to water movement.

The "U" shaped arm may be affixed to the base plate in a permanent manner, such as, for example, by welding the arms directly to the base plate or forming the "U" shaped arms and base plate together as one unit in an "integral, one piece construction". However, in embodiments utilizing welding or one piece construction, the "U" shaped arm must be engaged about a cylindrical sleeve prior to such welding, bonding or forming (integral structures) since, as described above, the "U" shaped arms are configured, affixed and arranged upon the base plate so as to firmly engage the parallel grooves of the cylindrical sleeve—engagement that prevents movement of the dock mooring bracket along the length of the sleeve-mounted to the base plate. In regard to embodiments of the present invention utilizing one piece bracket construction, such embodiments must be configured to include greater clearance between the "U" shaped arms and the parallel grooves of the sleeve so as to enable the brackets to be placed over the sleeve. Thus, certain alternate preferred embodiments must further comprise a means for tightening the "U" shaped arms engagement of the parallel grooves after such placement.

In the first preferred embodiment of the present invention, the "U" shaped arms are affixed to the mounting plate via conventional nuts and washers. In such embodiments, "U" shaped arm receiving holes are provided within and pass through the inside and outside faces of the vertical portion of the base plate and are positioned so as to receive the two free end termini of the "U" shaped arms. In such embodiments, the two termini of the "U" shaped arms include external threads for mating engagement of both screw-type fasteners such as, for example, nuts as well as non-screw type fasteners such as, for example, washers. More specifically, in certain preferred embodiment of the present invention, the external threads of the two proximal termini of the "U" shaped arms are engaged with corresponding nut fasteners followed by a washer prior to passing the proximal termini through corresponding "U" shaped arm receiving holes prepared within the vertical portion of the base plate. After passing through said receiving holes, an additional washer and nut is affixed to said termini so as to firmly engage each arm to the vertical portion of the base plate. As discussed above and below, the placement of the arm receiving holes in combination with the adjustment and fixation provided by nuts and washers allow the "U" shaped arms to align with and firmly engage parallel grooves of a cylindrical sleeve. The "U" shaped arm receiving holes are thus positioned so that, upon fixation of at least one "U" shaped arm to each of the vertical sections of the at least two base plates, the arms will be arranged and configured for capture of a selected groove of the cylindrical tube. The receiving holes for each of the "U" shaped arms will be parallel to the receiving holes for each additional "U" shaped arm.

In embodiments of the present invention wherein externally threaded "U" shaped arms are affixed to the mounting plate via washers and nuts, the pile capture area defined by the area within and bordered by the "U" shaped arms and base plate may be easily adjusted by simply rotating the subject nuts proximally (towards the termini of the arms), to increase the area (to loosen the bracket's engagement of the sleeve), and distally (away from the termini), to reduce the area (and increase the bracket's engagement of the sleeve). Thus, the one or more "U" shaped arms extending, for example, from two base plates located on opposite sides of an inboard mooring pile can be adjusted so as to position the pile, within the deck opening through which it passes, centrally, with substantially equal distance between the vertical portion of each base plate and the outer surface of the cylindrical sleeve placed about the pile.

For example, the curved portion of two or more "U" shaped arms extending from two base plates mounted to a top surface of a floating dock adjacent to and on opposite sides (180 degrees apart) of a deck opening (pile aperture) through which an inboard pile extends, may initially be slipped into, so as to engage a pair of adjacent (or nonadjacent) circumferential parallel grooves. Thereafter, a nut, followed by a washer, especially selected to mate with the external threads formed on the proximal termini of the "U" shaped arms are threaded and slipped (respectively) onto each of the two termini of the each arm. Thereafter, each of the termini of the "U" shaped arms are introduced into and passed through corresponding "U" shaped arm receiving holes located in the vertical portions of the opposing base plates. Thereafter, a second set of washers and nuts are placed upon the termini of the "U" shaped arms. Therefore, one nut and washer is then positioned proximal to the outer face of the vertical portion of the base plate and one nut and washer is positioned proximal to the inner face thereof in regard to each termini of the "U" shaped arms. Rotation of the nuts and screws proximally, towards the termini of the "U" shaped arms then provides the largest possible pile capture area defined by the "U" shaped arms and base plate. In this configuration, the bracket may be easily manipulated in regard to a cylindrical sleeve regardless as to whether or not the cylindrical sleeve has been placed upon a mooring pile. However, advancing the nut and washers located most adjacent to the termini of the "U" shaped arms (adjacent to the inner face) distally towards the curved distal portion of the "U" shaped arms will also advance the base plate towards the cylindrical sleeve. Such movement may be continued distally in order to obtain a tight and secure fit of the bracket to the cylindrical sleeve (and pile therewithin if sleeve is already placed upon pile.) More specifically, by adjusting the proximal nuts and washers affixing the "U" shaped arms to each of the opposing brackets, the pile may be centered within the opening so as to provide maximum protection for the decking and the pile. After the proximal nuts and washers have been so advanced to enable centering of the pile within the confines of the deck opening through which it passes, the distal nuts and washers located (adjacent to the outer face of the vertical portion of the base plate) may be advanced proximally towards the plate, so as to provide a secure fixation of the "U" shaped arms to the base plate.

As discussed above, the horizontal portion of the base plate preferably includes two, and preferably four or more anchor bolt receiving holes for receipt of anchoring means. More specifically, the means for affixing the bracket to a floating dock may include machine bolts, lag bolts, U bolts, screws or any combination thereof wherein such fasteners are passed through the anchor bolt receiving holes and thereafter are affixed to suitably prepared receiving holes provided within the structure of the floating dock itself. For example, properly sized and placed pilot holes may be prepared within the material comprising the floating dock. Thereafter, a lag bolt may be passed through each of the anchor bolt receiving holes of the base plate and thereafter be driven into the pilot holes. Alternatively, bolt receiving holes may be prepared within the floating dock and thereafter machine bolts are passed through each of the anchor bolt receiving holes of the base plate and through the bolt receiving holes prepared in the dock. Thereafter, conventional washers and bolts are utilized to secure the bolts, and the brackets to which they are attached, to the floating dock. In any event, and, as discussed above, the base plate is mounted upon a dock so that each pair of "U" shaped arm receiving holes, and an arm mounted therewithin, will be parallel to the surface of the water in which the dock lies.

In embodiments of the present invention wherein the "U" shaped arms are affixed to the base plate via nuts and bolts (as described above) the apparatus of the present invention is utilized as follows. Initially, an opening is prepared within the confines of the top surface of a floating dock. Most commonly, one or more locations are selected within the top surface of a floating dock. Thereafter, the top surface is cut so as to provide an opening through which a mooring pile may be passed and driven into the earth underlying the body of water in which the dock is located. Alternatively, a pre-existing and anchored mooring pile may be selected. In either case, an opening is made within the decking of the floating dock to accommodate one or more mooring piles. Thereafter, the opening in the dock is reinforced in the usual manner so as to tie together and support the cut ends of decking abutting the opening and so as to add greater strength to that portion of the dock. After the decking has been reinforced, at least two base plates are affixed to the top deck of the floating dock adjacent to the opening. When two base plates are utilized, they are advantageously positioned on either side of the opening, 180 degrees from one another, with the inner face of the vertical portion of each plate facing one another. The base plates are then affixed to the top decking of the floating dock as described above. The planar surfaces of the vertical and horizontal portions of the "L" shaped base plate are disposed 90 degree to one another. Thus, affixation of the base plate to the top deck of the floating dock will cause the vertical portion of the base plate to lie in a vertical relation thereto.

If a pre-existing pile is utilized, the dock is elevated, by the usual means, above the selected pile and then lowered so that the pile passes through the prepared opening. In alternative circumstances, a new pile may be lowered through the opening in the decking and thereafter driven into an anchored position. Thereafter, the cylindrical sleeve, described above, is, placed over the pile. In embodiments of the present invention wherein the cylindrical sleeve does not additionally comprise a buoyant base, the cylindrical sleeve is temporarily affixed to the pile with, for example, a nail or screw, until the below-described mounting is completed. In such instances, it is preferred that the sleeve be affixed to the mooring pole so that the inferior termini of the sleeve (closest to the bottom of the pile) is located approximately 2 to 5 feet inferior to and below the most inferior portion of the bracket base plate (when mounted upon the dock). However, it is most preferred that the sleeve is temporarily affixed to the pile at such a point as to enable the inferior termini of the sleeve to be located 2.5 feet below the water line of the floating dock. However, such distances are subject to any particular floating dock being located in an area exhibiting more than 2.5 feet water depth during extreme low tide. In any case, the cylindrical sleeve must not be affixed to the dock in a position which would cause the inferior terminus of the sleeve to come into contact with the sea bottom during extreme low tides.

After the sleeve has been temporarily affixed to the pile, a parallel groove is selected to be engaged by the bracket. Thereafter, a "U" shaped arm is placed about the sleeve so as to engage and lie within the selected groove. Thereafter, one nut and one washer is threaded onto each of the externally threaded termini of the "U" shaped arm and advanced, distally, towards the sleeve. Thereafter, the termini of the "U" shaped arms are passed through "U" shaped arm receiving holes located on each of the vertical portions of the at least two base plates. In embodiments of the present invention wherein two "L" shaped base plates are utilized and placed on opposing sides of the pile aperture (180 degrees apart) the "U" shaped arms are adjusted as follows. A washer and thereafter a nut are threaded upon and advanced distally along each of the proximal termini of the "U" shaped arm until the inner part of the semi-circular portion thereof biases against and moves the floating dock so as to cause the mooring pile to be located approximately equidistant from the outer faces of each of the base plates. Thus, adjustment of the nuts and washers located adjacent the outer face of the vertical portion of the base plate is utilized to center the pile within the opening between the two brackets. Thereafter, the nuts and washers located distal to the plate are advanced proximally, against the opposite face of the base plate so that the at least two "U" shaped arms are firmly affixed to the base plate. The "U" shaped arms are especially configured to exhibit a dimension so that, when they have firmly engaged selected parallel grooves of the cylindrical sleeve and are adjusted—via the aforementioned nuts and washers—so as to firmly engage the sleeve. In certain embodiments of the present invention, four brackets placed at a 90, 180, 270 and 360 degree position about the top deck opening through which the inboard pile extends. In such embodiments, at least one "U" shaped arm is mounted upon the vertical portion of each base plate as discussed above. In such instances, the adjustment of the outer (adjacent the outer face) nuts and bolts anchoring the "U" shaped arms to the base plates is utilized to center the pile within the deck opening in regard to four, rather than two points of orientation.

In certain preferred embodiments, only one base plate is utilized. In such instances, one "U" shaped arm depending from such base plate may be utilized to secure the dock to the pile via engagement with a selected circumferential groove. However, it is preferred, which utilizing only one base plate for mooring of a dock, that at least two "U" shaped arms depend therefrom As mentioned above, certain preferred embodiments of the present invention include a buoyant base affixed proximate to the inferior terminus of the cylindrical sleeve. The buoyant base is tubular in configuration and includes an outer surface and an internal core surrounding and defining a central bore. The internal core circumscribes and forms what may be described as the central bore of the buoyant base. This central bore is configured to have a dimension sufficient so as to a proximal portion of the cylindrical sleeve to fit therewithin. The inner coil is thus disposed circumferentially and perpendicular to the cylindrical sleeve. In certain preferred embodiments of the present invention, the inner core is comprised of a coil having parallel rings and grooves on its outer surface and circumscribing a central bore. In this configuration, a portion of the parallel rings and grooves formed on the outer surface of the inner coil of the buoyant base are in contact with and aligned generally perpendicular to the parallel rings and grooves of that portion of the cylindrical sleeve passing through the bore of the buoyant base.

The outer surface of the buoyant base is advantageously covered by a tough, resilient cover, such as, for example, a polyvinyl, polyester or nylon composition. The cover may be fabricated of one or more sections and tied (or otherwise affixed) to the outer surface of the buoyant base. The inner core of the buoyant base is comprised of example, a circumferential polyethylene, polyvinyl or polyester hollow tube positioned within the core. Additionally, the core of the buoyant base is filled with a buoyant material such as, for example, a polystyrene foam thereby imparting great buoyancy to the base. In preferred embodiments of the present invention utilizing a buoyant base, the buoyant material utilized within the base demonstrates sufficient buoyancy so as to assure that the entire length of the cylindrical sleeve distal (superior) to the distal (superior) terminus of the base lies above the water line when the apparatus is applied to a pile.

In embodiments of the present invention including a buoyant base, it is preferred—but not required—that the buoyant base be located from about 2 to about 5 feet from the inferior terminus of the sleeve. This configuration allows the buoyant base to aid in enhancing the buoyancy of the floating dock to which the cylindrical sleeve is affixed while, simultaneously serving as an additional shock absorber.

As mentioned above, the apparatus of the present invention is especially configured for floating docks wherein the height of the dock, relative to adjacent pilings, is subject to change in accordance with changing tides, water levels, etc. and in circumstances wherein wave an other water movements tend to cause a floating dock to list. As also mentioned above, the present invention also provides, with embodiments incorporating a buoyant base mounted upon the cylindrical sleeve, a means of increasing dock buoyancy to a floating dock as well as providing buoyancy to a dock not including, as an integral part of such dock, a buoyancy means sufficient to provide suitable floatation thereto.

The inner bore diameter of the coaxially mounted cylindrical sleeve, although closely adapted to the pile upon which it is placed, allows the sleeve to easily move up and down a mooring pile upon which it is placed, changes in water levels, causing a floating dock moored to a piling by means of the apparatus of the present invention, results in a simple, relatively smooth and non-traumatic upward and downward traverse of the sleeve along the pile. It is preferred that, in order to achieve such close adaptation of sleeve to pile, that the inside diameter of the cylindrical sleeve be from about 1.0 inches to about 4 inches larger than the outside diameter of a pile to which it is applied. It is still further preferred that the inside diameter of the cylindrical sleeve be from about 1.5 inches to about 3 inches larger than the outside diameter of the cylindrical sleeve. It is still further preferred that the inside diameter of the cylindrical sleeve be from about The apparatus of the present invention thereby avoids listing, capsizing and other disturbances caused to floating docks by other means of anchoring same to piles. In addition, engagement of two or more adjacent or non-adjacent parallel circumferential grooves of the cylindrical sleeve by "U" shaped arms extending from two or more base plates greatly reduces listing of the floating dock due to wave/wake action or uneven loading of the dock. Since, as described in greater detail below, two or more "U" shaped arms are firmly engaged, on a distal portion thereof, within parallel circumferential grooves of a coaxially placed cylindrical sleeve and, on a proximal portion thereof, to at least two base plates which, in turn, is firmly bolted to the dock, the device greatly reduces listing of the floating dock.

DETAILED DESCRIPTION

Figure 1:
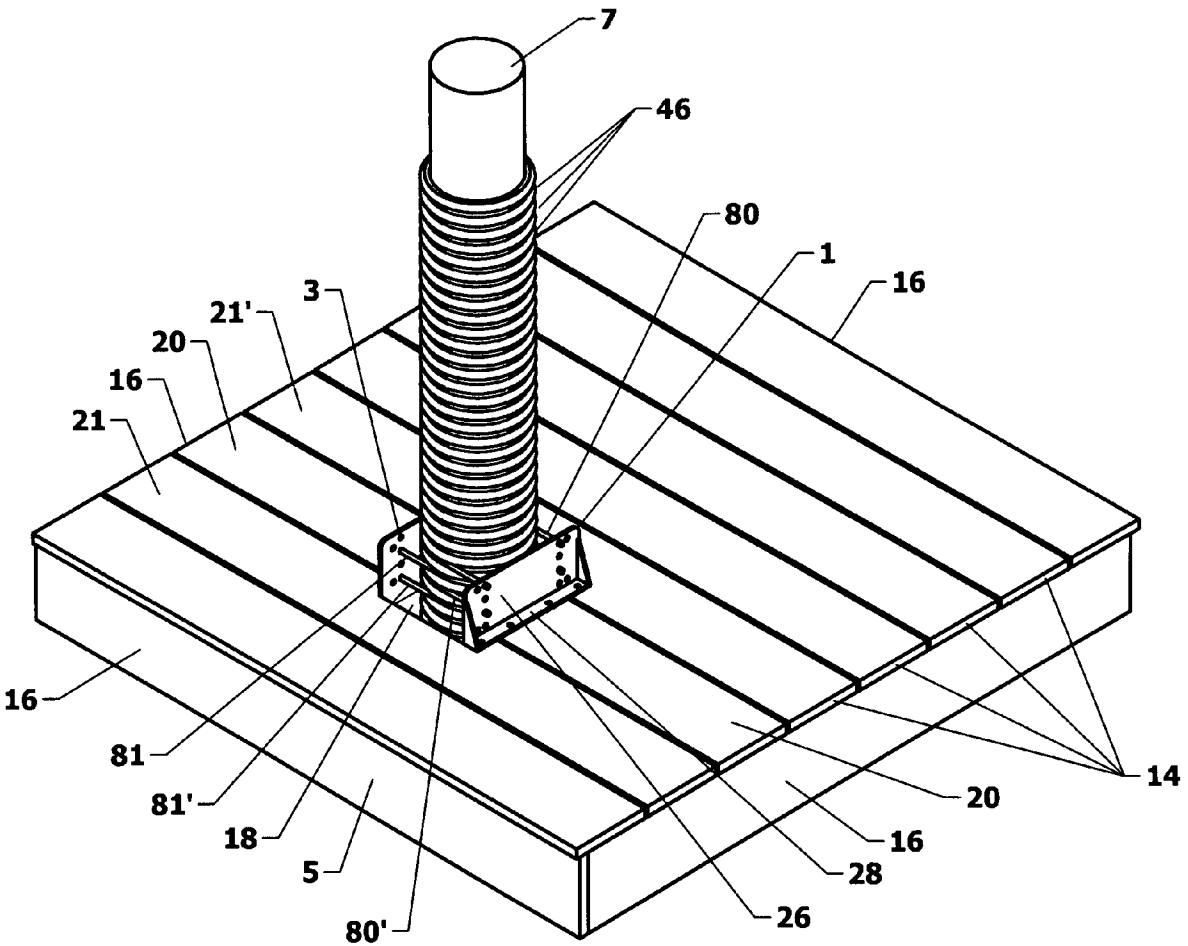
FIG. 1 is an isometric view illustrating the apparatus of the present invention affixing a floating dock to a mooring pile utilizing two base plates.

FIG. 1 illustrates a preferred embodiment of the present invention wherein two brackets comprised of "L" shaped base plates 1 and 3 and "U" shaped arms depending therefrom are utilized to moore floating dock 5 to pile 7. More specifically, cylindrical sleeve 4 is coaxially mounted upon pile 7. The central bore of the cylindrical sleeve is selected to demonstrate a dimension, as discussed above, so as to enable the sleeve to slip over and, thereafter, move up and down along a length of the pile without binding so as to accommodate motion of the dock caused by changes in tide, currents, wave activities and other disturbances. As discussed above, each of the brackets includes one or more "U" shaped arms (80, 80', 81, & 81') which, as described in more detail, above and below, engage selected circumferential grooves 46 of the outside surface of the cylindrical sleeve, so as to anchor the sleeve, and the pile therewithin, to the floating dock each bracket is affixed to.

Dock 5 is illustrative of a floating dock which are typically fabricated of either a wood or synthetic plastic frame having a top surface which is often covered with decking 14 as shown in the figures, or other flat structural elements such as sheets of plywood or plastic. Such floating docks typically include, within the framing thereof, and below the decking, floatation material such as, for example, closed cell foam material that provides buoyancy to the dock. Such docks may utilize piles to stabilize (or moore) the dock at a desired location. Typically such piles may be located beyond the peripheral edges 16 of such docks, or located inboard, within the perimeter 16. When piles utilized for such mooring are located within the perimeter of a dock, they may be referred to as inboard piles. In order to allow the use of such inboard piles, the top surface of the dock must have a pile aperture (or opening) 18 so as to enable passage of the pile, vertically from its moored position in beneath the sea bed underlying the water in which the dock is moored, upward, through and beyond the top surface of the dock. In preparing the top surface of a floating dock for such an aperture, it is often necessary to cut the top surface of the dock in such a way as to weaken its weight bearing strength. For example, the roughly rectangular pile aperture 18 shown in the figures completely bisects plank 20 and partially interrupts planks 21 and 21'. Such structural weakening may be ameliorated by using crossbeams lying under the decking, perpendicular to the cut and partially cut decking in order to tie them together with uncut decking lateral thereto.

The brackets of preferred embodiments of the present invention include an "L" shaped base plate having a vertical planar portion 26 and a horizontal planar portion 28. The "L" shaped base plate is positioned so that the bottom surface 30 of the horizontal portion of the base plate lies upon the top surface of a floating dock, directly adjacent to the pile aperture made therein. The base plate is further positioned so that the outer face 32 thereof faced the aperture and a pile positioned therethrough. As discussed above, in preferred embodiments of the present invention, the vertical and horizontal portions of the "L" shaped bracket are configured so as to define a 90 degree angular relationship. Therefore, when, as discussed above, the bottom surface of the planar horizontal portion of the base plate is affixed to the top surface of a floating dock (adjacent to a pile aperture), the vertical portion of the base plate will lie perpendicular to the top surface of the dock and, accordingly, roughly perpendicular to the surface of the body of water in which the floating dock is placed. Since, as described above, the pile bedded below the floating dock and extending through the aperture is to be set plumb, and the columnar sleeve coaxially placed thereon is necessarily aligned with the pile, the "U" shaped arm will engage the circumferential (horizontal) grooves of the columnar sleeve in such a manner as to lie perpendicular to the pile and parallel to the surface of the floating dock to which it is mounted via the base plate. Such an arrangement has the effect of stabilizing the floating dock in a position wherein it resists listing and lies parallel to the water bed underlying the dock.

It is preferred that the base plate be fabricated from a corrosion resistant material such as, for example, stainless steel, galvanized steel, brass, composite reinforced plastic materials and fiberglass.

Figure 7:
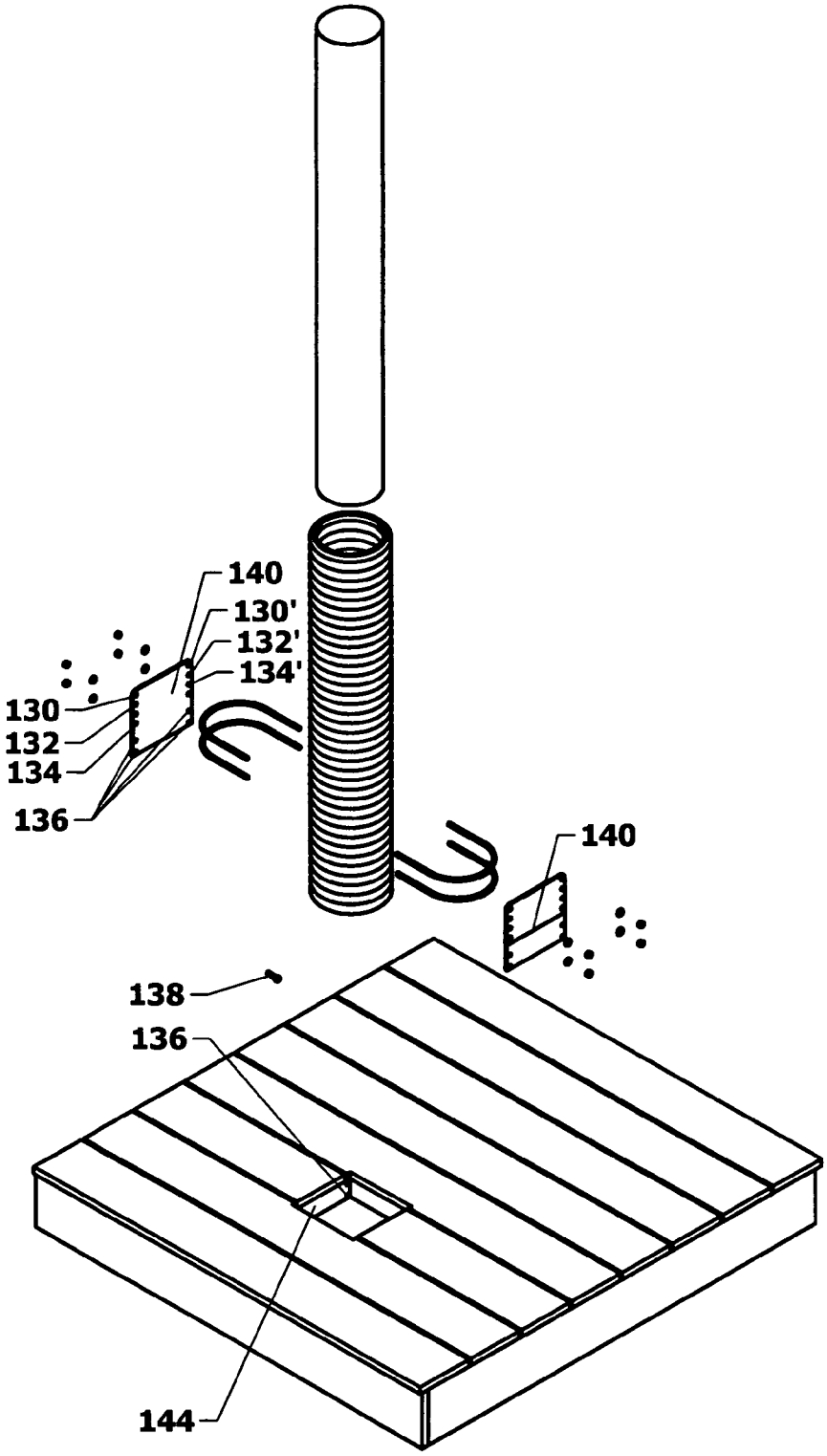
FIG. 7 is an illustration of an embodiment of the present invention utilizing a base plate having a flat plate configuration.

Although, as discussed above and below, preferred embodiments of the present invention utilize brackets including "L" shaped base plates, the present invention also contemplates brackets utilizing flat base plates as illustrated in FIG. 7. As also discussed above and below, the "L" shaped base plate of the present invention advantageously enables, by means of fixation of the horizontal planar portion thereof to the top decking of a floating dock, the "tying together" or, in other words, providing a structural cross beam so as to strengthen the ends of top surface planking cut in order to provide the aperture through which an inboard pile is located. The "L" shaped base plate of the present invention is especially capable of providing this reinforcement feature when it is placed adjacent to a prepared aperture overlying the cut ends of the decking (as illustrated in FIGS. 1, 2, 4 and 5. However, in certain instances, the top surface of a floating dock may be comprised of plywood or some other sheet material—such as plastic—wherein the preparation of a pile aperture does not require the cutting—and thus weakening—of individual planks. In such instances, the flat base plate illustrated in FIG. 7 may be advantageously utilized. The flat style base plate 131 of the present invention also includes "U" shaped arm receiving holes 130/130', 132/132' and 134/134' which, as described in regard to the "L" shaped base plate, above and below, are also prepared so that, when the base plate is mounted to the sides (or so as to form the sides) of a prepared aperture via the anchor bolt receiving holes 136 and anchor bolts 138 illustrated in FIG. 7, a line drawn through the center of each member of the "U" shaped arm receiving holes will be parallel to the top surface of the floating dock. In order to assure that the flat base plate is affixed to the dock in such a manner as to assure such alignment, an alignment line 140 may be provided upon the inner and more importantly the outer surface of the base plate. The alignment line is parallel to each pair of "U" shaped arm receiving holes. Therefore, if, when mounting the base plate to the inner surface of the floating dock structure surrounding the pile aperture the alignment line is aligned with the top surface of the dock, each pair of "U" shaped arm receiving holes will also be parallel with the top surface of the dock. This parallelism will enable a "U" shaped arm, which has engaged a selected groove of the cylindrical sleeve, to also be aligned parallel with the top surface of the floating dock. Such alignment, as stated above and below, tends to increase the stability of the floating dock. The anchor bolts, in such embodiments, engage either bulkheads 144 or framing elements, —such as joists—supporting the top decking or sheets forming the top surface of the dock—below the top surface of the dock and abutting the aperture so as to provide affixation of the flat base plate.

Figure 8:
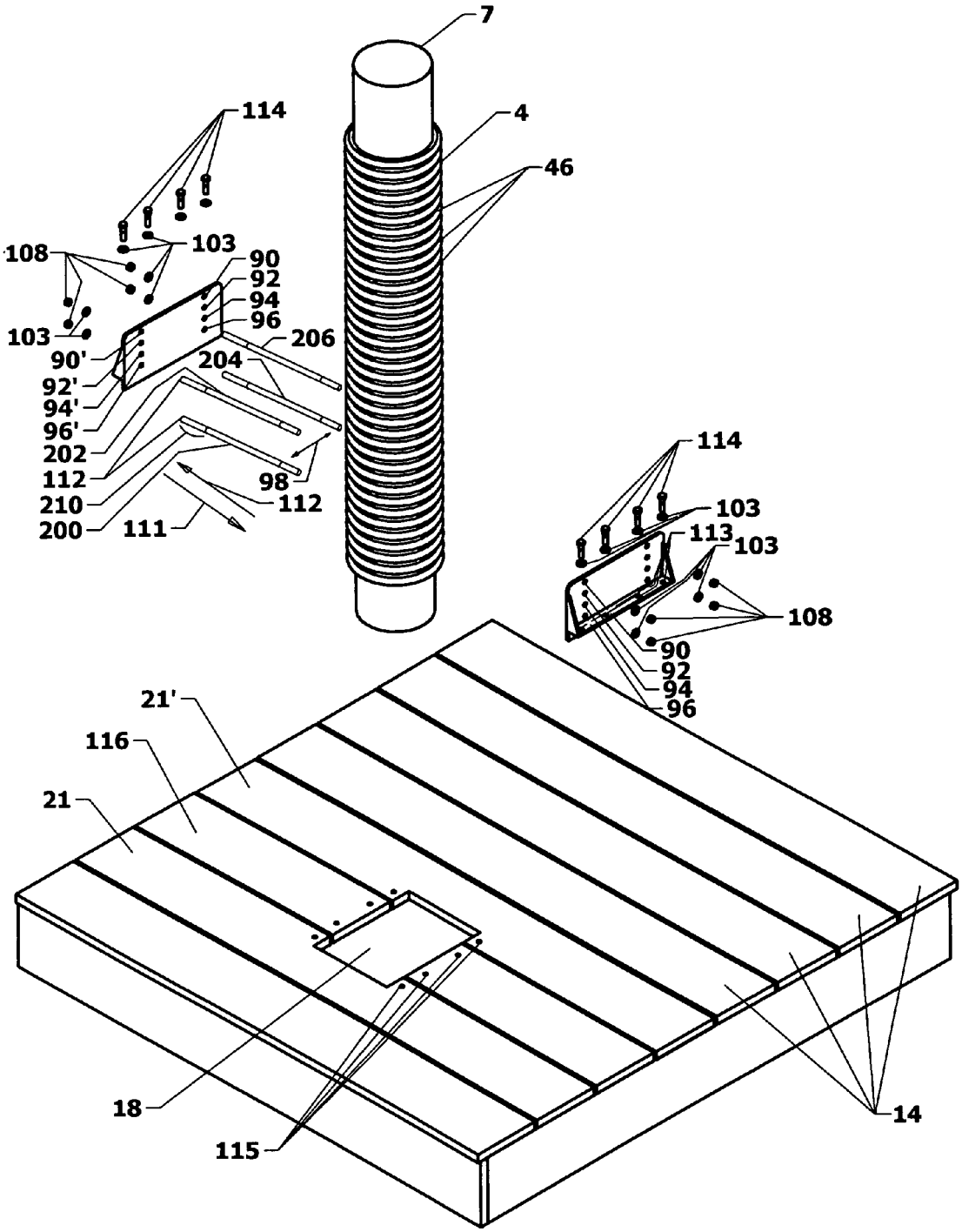
FIG. 8 is an illustration of an alternate embodiment of the present invention utilizing at least two elongated bars to engage a cylindrical sleeve shown in an exploded isometric perspective.

The present invention also contemplates, that the "U" shaped arms, as shown in the figures, and especially FIG. 7, can arise and be anchored directly to the structure of the floating dock—and not from "L" shaped, flat or other types of brackets. In such instances—as shown in FIG. 8, the "U" shaped arms are mounted directly within the substance/composition/material from which the floating dock is constructed. For example, the floating dock illustrated in FIG. 8 may is fabricated from a highly durable material such as a hard wood having sufficient hardness and strength, a reinforced plastic or metal composition. In such applications, an alternate embodiment of the present invention affixes one or more "U" shaped arms (or the at least two elongated rods discussed below) directly to, for example, a bulkhead forming a wall of the pile aperture—without the need of a separate base plate for such affixation—. In such instances, of course, "U" shaped arm receiving holes formed in such bulkheads are placed and positioned so that a line connecting the center most point of each of the two holes making up each pair is parallel to the top surface of the floating dock. In fact, in applications wherein a floating dock is fabricated from a reinforced plastic material or metal, the bulkhead (anchoring) areas may, in fact, directly engage, or, be continuous with one or more "U" shaped arms. In regard to floating docks constructed of a metal, the "U" shaped arms may be directly welded adjacent to the aperture as long as they are oriented parallel to the top surface of the floating dock, as discussed above. In applications wherein the floating dock is fabricated from a plastic material, the "U" shaped arms may be fabricated from a reinforced plastic material which is bonded to, or which is an integral part of the floating dock—while being oriented parallel to the top surface of the dock as discussed above—. In such configurations, as long as the arms are held in a substantially parallel relationship with the circumferential grooves of the cylindrical sleeve, the bracket, in such alternative embodiments, now being comprised of simply the cylindrical sleeve, and at least one "U" shaped arm—or, as discussed below, at least two elongated bars—, will provide the same stabilizing and mooring functions as the other embodiments disclosed herein utilized a separate base plate to affix the "U" shaped arms to the floating dock.

Figure 9:
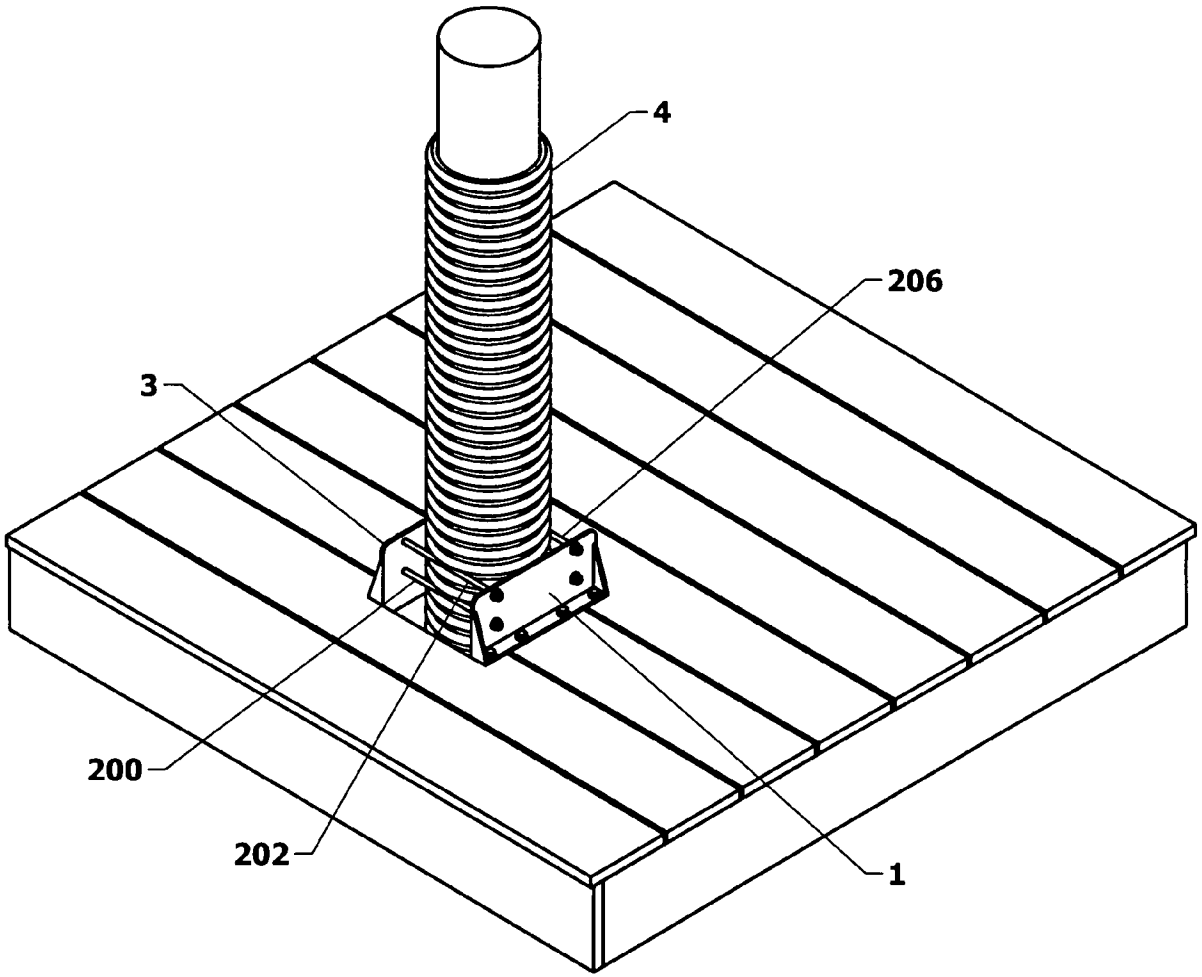
FIG. 9 is an isometric view of the embodiment of the present invention shown in FIG. 8.

FIG. 9 illustrates an embodiment of the present invention wherein the apparatus is comprised of a cylindrical sleeve, a mooring bracket and a means of affixing the mooring bracket to a floating dock. In the embodiment illustrated in FIG. 9, the mooring bracket is comprised of at least two elongated rods, and a means of affixing the elongated rods to a floating dock adjacent to a pile aperture. As in regard to all other embodiments herein, the cylindrical sleeve is a tubular structure having a superior terminus, an inferior terminus, a length, an outer surface, an outside diameter, an inside diameter and an inner surface surrounding a central bore, wherein the inner surface of said sleeve has a substantially smooth contour and the inside diameter is selected to enable the sleeve to be placed coaxially upon and closely adapt to a mooring pile of a given outside diameter while enabling said cylindrical sleeve to move up and down along said pile without binding thereto and wherein the outer surface of the sleeve is configured to include a contour demonstrating a plurality of parallel circumferential rings, said rings, in turn, defining parallel circumferential grooves therebetween.

In regard to the embodiment illustrated in FIG. 9, the mooring bracket is comprised of at least two elongated rods and a means ("L" shaped base plates) of affixing the elongated bars to the floating dock. The rods have a longitudinal axis, a length, two termini and an outside diameter. The outside diameter of the at least two rods is selected so as to enable each of the at least two rods to be placed within closely adapt to, and firmly engage a selected circumferential groove of the cylindrical sleeve.

The alternate preferred embodiment illustrated in FIG. 9 utilizes an "L" shaped bracket as a means of affixing the at least two rods to a floating dock adjacent to a pile aperture. As discussed in regard to the "U" shaped arms of other embodiments disclosed herein, the elongated rods of the alternate preferred embodiment are mounted adjacent to the pile aperture in such a manner so that the longitudinal axis of each of said rods is oriented in a parallel relation with the top surface of the floating dock while, at the same time, the rods are also affixed to the floating dock, in such a position, so as to enable each such rod to firmly engage a portion of a selected circumferential groove of the cylindrical sleeve. More specifically, each terminus of the elongated rods is mounted to the floating dock in order to provide the aforementioned orientation and engagement. In the alternate preferred embodiment illustrated in FIG. 9, a portion of the external surface of the elongated rods proximate to the two termini thereof include an external threading and diameter so as to allow each rod to be mounted within a selected elongated rod receiving bore of the "L" shaped base plate. The position and orientation of each such elongated rod receiving holes—which are equivalent to the "U" shaped arm receiving holes—enables the aforementioned parallel orientation with the top surface of the floating dock and firm engagement with a selected circumferential groove of the cylindrical sleeve. This arrangement in combination with the selected outside diameter of the elongated rods enables the at least two elongated rods to closely adapt within and firmly engage selected circumferential grooves of a cylindrical sleeve coaxially placed about an inboard pile. Thus, stabile mooring of the floating dock to the inboard pile is provided while simultaneously achieving resistance against listing of the dock in reaction to disturbance of water in which the dock is positioned.

As shown in FIG. 9, the at least two elongated rods are mounted via "L" shaped base plates so that the rods engage the cylindrical sleeve on either side of the sleeve. More specifically, if the engagement of each rod with a selected groove of the cylindrical sleeve is described as tangential, then the at least two elongated rods are mounted to the floating dock, adjacent to the pile aperture, in such a manner so that such tangential contact occurs on opposing (approximately 180 degree) sides of the columnar sleeve. Although it is not necessary that an equal number of elongated rods contact the cylindrical sleeve on such opposing sides, there must be at least one such rod contacting the sleeve on each such opposing side in order to maintain engagement of the elongated rods with the sleeve. If for example, all of the elongated rods were located with the center of their tangential contacts with the cylindrical sleeve at one side of the sleeve (for example, at 180 degrees) and there was no elongated rod contact with the sleeve on the opposing side, then there would be no opposing force available to hold the rods within the circumferential grooves.

As shown in FIGS. 8 and 9 the columnar sleeve 4 is coaxially placed upon the pile as described above and below. A portion of each of the four elongated bars 200, 202, 204, and 206 is mounted in receiving hole (90, 92, 94, and 96) so as to engage selected circumferential grooves 46 formed in the outer surface of the columnar sleeve. Thereafter, the two externally threaded termini of each of the elongated rods is introduced through a pair of receiving holes (90/90', 92/92', 94/94' & 96/96) provided within the vertical portion of the "L" shaped base plate and held in place within said receiving holes by means of washers 103 and nuts 108. As illustrated in the figures, preferred embodiments of the present invention include elongated rods which are shaped, machined and configured to include external threading 210 of a portion of the external surface of the rod adjacent to and extending to each of said termini prepared to matingly engage with the aforementioned nuts and washers. As described above, each pair of the elongated rod receiving holes is prepared so that a line connecting the center of each hole of a give pair is parallel to the horizontal portion of the mounting plate, the top surface of the floating dock to which the base plate is anchored, as well as parallel to a line connecting each member of all other "U" shaped arm receiving holes prepared in the vertical portion of the plate. Each circumferential groove 46 of the columnar sleeve selected for engagement by a portion of the elongated rod so that the termini of said arm can be aligned with a selected receiving hole located in opposite sides of the pile aperture, and, in regard to the embodiment illustrated in FIGS. 8 and 9, a receiving hole within opposing "L" shaped base plate configured so as to orient the elongated bar parallel to the top surface of the floating dock and in alignment so as to firmly engage a selected circumferential groove when the elongated bar is affixed to said base plate as described above. Therefore, each rod is aligned with a pair of receiving holes, each member of each such pair being located on opposing "L" shaped base plates (base plates located on either side of the pile aperture) such as, for example, the following pairs: 90/90', 92/92', 94/94' & 96/96.

As mentioned above, the present invention contemplates embodiments that utilize one or more base plates. However, in regard to embodiments of the present invention wherein an elongated bar, rather than an "U" shaped arm is utilized to engage selected circumferential grooves of the columnar sleeve, the elongated bar must be affixed to the dock at both termini of the elongated bar. Thus, in embodiments of the present invention utilizing elongated bars for engagement of the columnar sleeve, if the means for affixing such elongated rods to the dock is either and "L" shaped base plate or a flat base plate, two of such base plates must be mounted, upon opposing sides of the pile aperture, in order to properly stabilize, affix and orient the elongated bar as described above. In embodiments of the present invention wherein the elongated bars are affixed to the floating dock via direct mounting to the dock itself—such as by means of mounting the termini of each elongated rods through receiving holes prepared in bulkheads or headers adjacent to or forming walls of the pile aperture and utilizing washers and nuts to affix the elongated rods therein, such receiving holes must be prepared on opposing sides of the pile aperture in order to achieve the same stabilization and position as discussed above.

In FIGS. 1, 2, 4 and 5 and 9, embodiments of the present invention are illustrated wherein two base plates are utilized to moore a floating dock to an inboard pile. However, in other preferred embodiments of the present invention, —wherein, for example, a "U" shaped bracket is utilized to engage the columnar sleeve, 3 or more brackets may be utilized. Embodiments of the present invention utilizing an elongated rod to engage the columnar sleeve must utilize mounting means located on opposite sides of the pile aperture. Therefore, in embodiments utilizing base plates for mounting of elongated rods, two or four such base plates are utilized.

Figure 4:
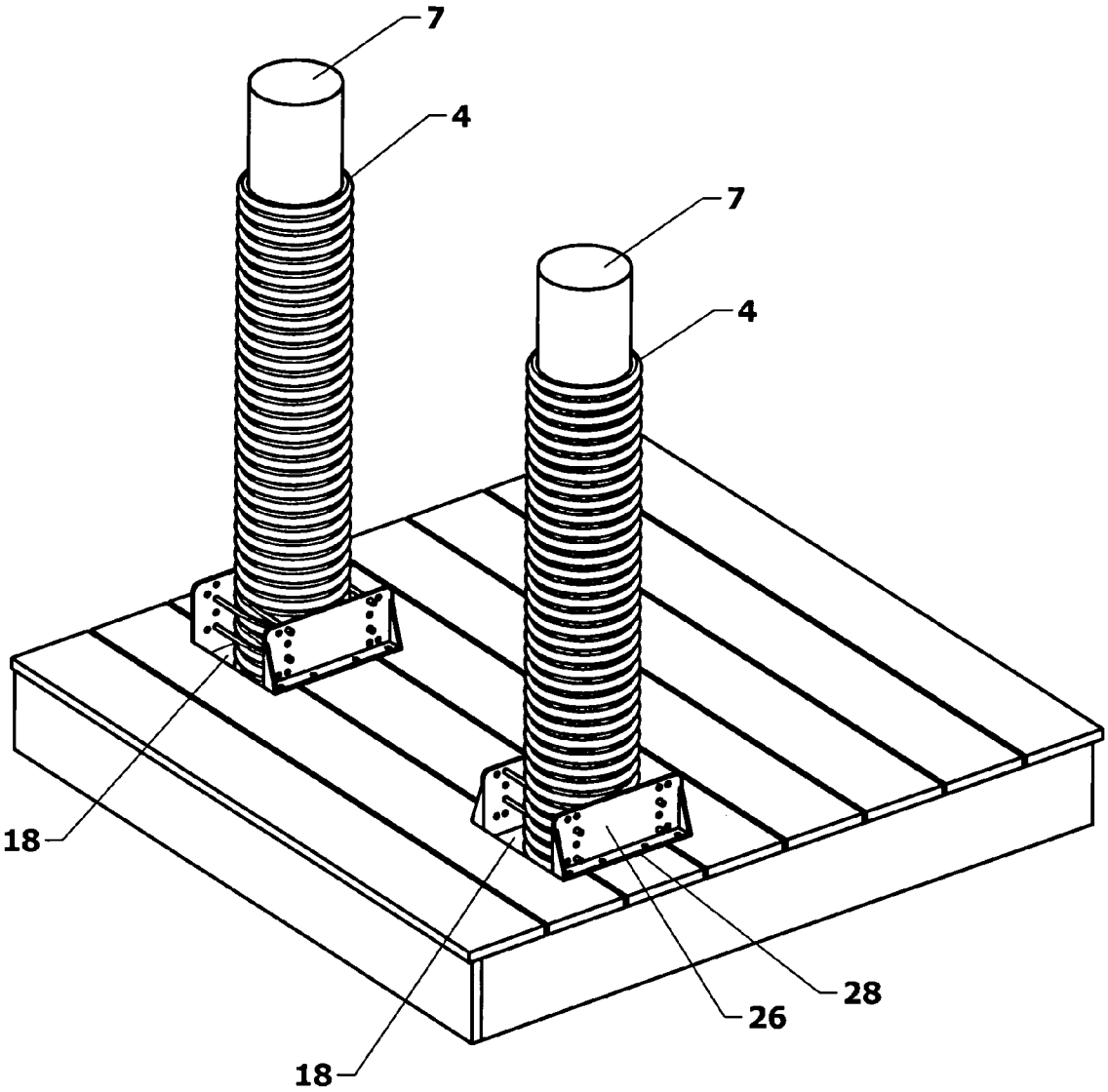
FIG. 4 is an isometric view illustrating the apparatus of the present invention affixing a floating dock to two mooring piles utilizing four base plates.

FIG. 4 illustrates an embodiment wherein four brackets are utilized. In fact, certain preferred embodiments of the present invention utilize only 1 bracket, but in such cases, it is especially preferred that each base plate include at least two "U: shaped arms extending from each base plate to affix the floating dock to the cylindrical sleeve placed upon the pile.

Figure 5:
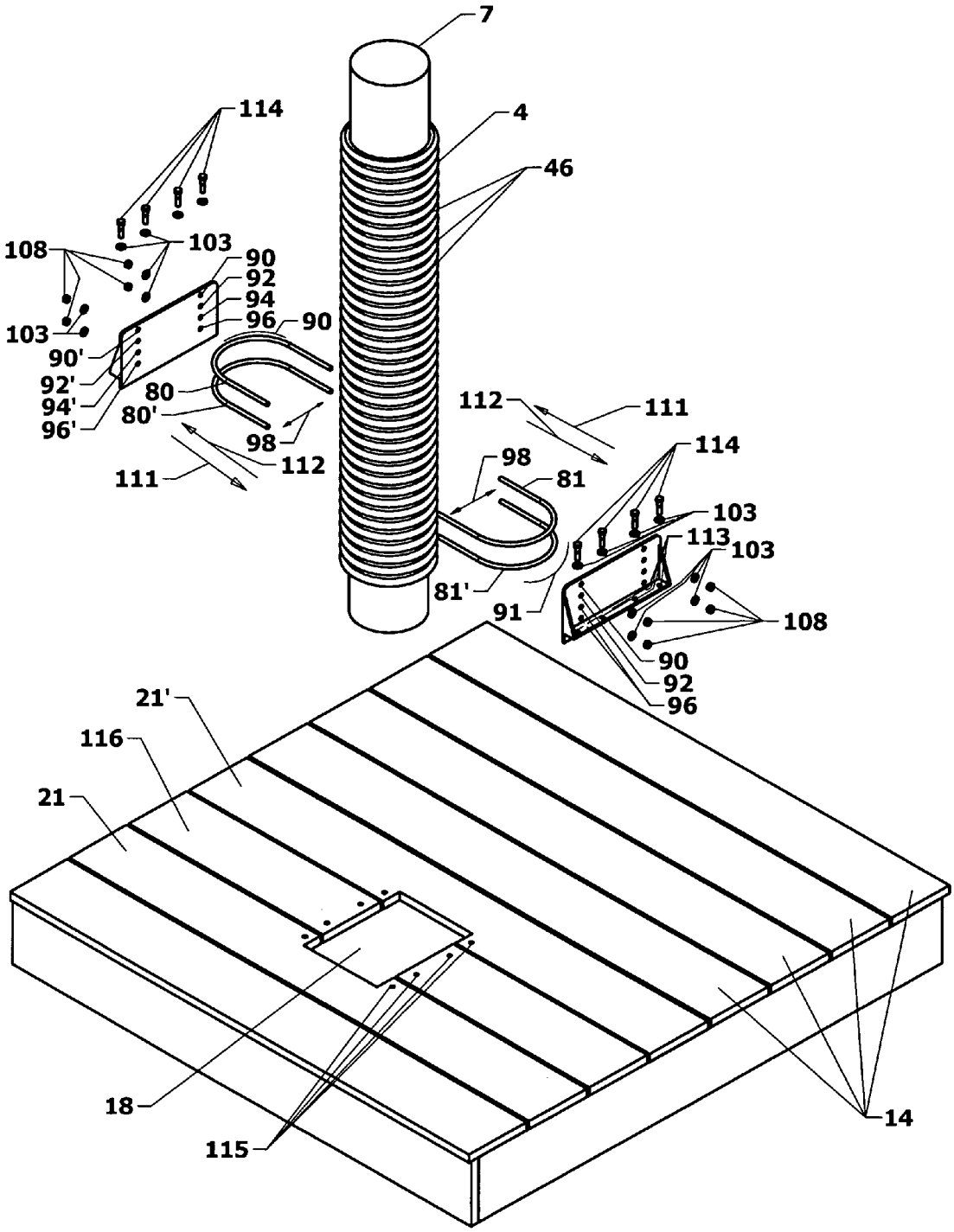
FIG. 5 is an isometric exploded view of the apparatus of the present invention shown in FIG. 1
Figure 6:
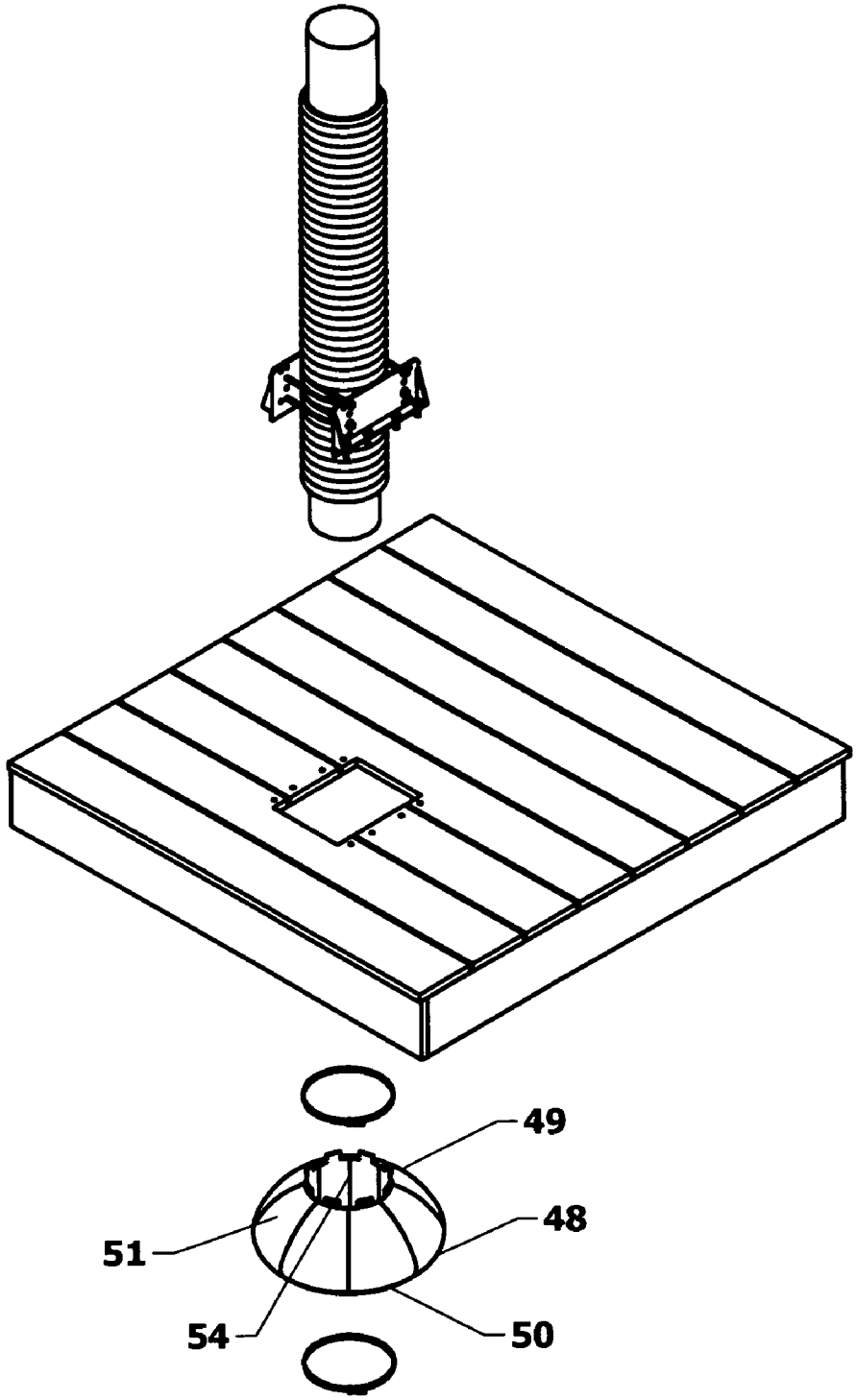
FIG. 6 is an isometric exploded view of an embodiment of the present invention including a buoyant base.

In order to affix an "L" shaped base plate of the present invention to the top surface of a floating dock, nails, machine bolts, lag bolts, screws, U bolts or any other fastener known to the art may be utilized so long as the fastener selected demonstrates sufficient retention to dock in which it is placed so as to resist inadvertent removal therefrom. It is preferred that the fasteners be fabricated from corrosion resistant materials such as, for example, stainless steel, galvanized steel, brass or composite materials. For this purpose, base plate mounting holes 113 may advantageously be prepared as bores passing through the top and bottom surfaces of the horizontal portion of the "L" shaped base plate. As illustrated in FIG. 5, mounting bolts 114 and washers 103 may be utilized to affix the horizontal portion of the base plates to a floating dock at the periphery of pile aperture 16 by engaging and passing through mounting holes 115 prepared in the top surface of the floating dock. Thereafter, such fixation may, for example, utilize lock washers and nuts to tighten and retain the mounting bolts tightly in place. It is contemplated that other forms of fixation of the base plate to the top surface of the dock such as, for example, nails, machine bolts, lag bolts, screws, U bolts, adhesives, welding and integral forming, depending, in part, upon the material utilized to form the top deck of the floating dock.

Once the "L" shaped base plate is affixed to the top surface of the floating dock (as described above), the bracket may be affixed to an inboard pile as follows. As discussed above, the pile is either set, from above, through the dock and into the bed below the water underlying the dock or, in other instances, the dock may be lowered upon an existing set pile. In still other instances, the dock may be fabricated around an existing pile. In any event, the pile 7 is positioned so that it extends from a bedded position in the earth underlying the water in which the dock is located upward and through the pile aperture. It is preferred that the pile be set as plumb as possible. Thereafter, the columnar sleeve 4 is placed coaxially about the pile and temporarily positioned using, for example, a nail (as discussed above). Thereafter, a "U" shaped arm is placed so that the curved semi-circular portion 91 of the arm securely engages a selected circumferential groove 46. The circumferential groove is so selected so that when the horizontal arm is positioned so as to engage the groove—as shown in the figures—they are parallel to the top surface of the dock, the two termini 17 of the "U" shaped arms will align with a pair of "U" shaped arm receiving bores (such as 90, 92, 94 & 96) formed within the vertical portion of the "L" shaped bracket. Prior to actually passing the termini of the "U" shaped arms through the receiving bores, a fastener such as, for example a washer and bolt may be threaded upon an externally threaded portion of the "U" shaped arms adjacent to the termini thereof. Using such "outer" fasteners adjacent the outer face of the vertical portion of the "L" shaped bracket may serve to further stabilize the bracket, but is not necessary for use thereof.

As the two termini of the "U" shaped arms pass through the receiving bores (90/90', 92/92', 94/94' and 96/96'), the externally threaded surfaces thereof are engaged by, for example, washers 103 and locknuts 108. As the nuts and washers are advanced distally, in the direction of the pile, contact between nut/washer and the inner face 26 of the vertical portion of the "L" s shaped bracket tends to draw the base plate (and dock to which it is affixed) closer to the pile. In embodiments of the present invention wherein only one bracket is utilized, it is preferred that at least two "U" shaped arms be mounted upon the vertical portion of the base plate so that the base plate engages at least two adjacent or non-adjacent circumferential groove of the cylindrical sleeve. However, as shown in FIGS. 1,2, 4, 5, 8 and 9, it is preferred that at least two brackets are utilized. In such instances, it is still preferred, but not required, that each of the two brackets comprise base plates which engage the cylindrical sleeve with two or more "U" shaped arms (or in regard to FIGS. 8 & 9, elongated rods). However, in instances, such as that illustrated in FIG. 4, wherein four brackets are utilized, it is preferred that only one "U" shaped arm is mounted upon the vertical portion of each "L" shaped bracket. In certain alternate preferred embodiments of the present invention, the "U" shaped arms may be welded to the vertical portion of the base plate, rather than utilizing conventional fasteners. In such embodiments, the "U" shaped arm receiving holes are utilized as the precise points of welding so as to assure, as described above and below, that the "U" shaped arms will be aligned parallel with the top surface of the floating dock upon which the base plate is mounted.

In embodiments of the present invention wherein only one base plate is utilized or wherein "U" shaped arms depend directly from one side of the pile aperture, it is highly preferred that each "U" shaped arm mounted thereupon be affixed to the vertical portion of the baseplate via both inboard and outboard nuts, washers or other fasteners. More specifically and, as an example, in such cases, prior to each "U" shaped arm being placed in a pair of horizontal receiving bores (and after the semi-circular inner portion 91 thereof has been set within a selected circumferential groove of the columnar sleeve:

1. a nut and washer are advanced distally 112 along the externally threaded portion of the two termini of each arm; thereafter 2. each of the two termini of the arm engage and pass through a pair of horizontally aligned receiving holes prepared within the vertical plate; and then 3. an additional washer and nut are advanced distally along the threaded portion of each termini.

The term "distally advanced", "advanced distally", as utilized throughout the specification and in the claims refers to, in regard to the "U" shaped arms engaging the columnar sleeve, movement away from the termini thereof and towards the semi-circular portion thereof. The term "proximally advanced" or "advanced proximally", as utilized throughout this specification and within the claims refers to movement away from the semi-circular portion of the "U: shaped arms and towards the termini thereof.

The above-described fixation technique, wherein a washer and nut is located both proximal and distal to the planar surfaces of the vertical portion of the base plate provides greater stability to the "U" shaped arm. Such configurations are especially desirable in embodiments of the present invention wherein only a single bracket comprising one base plate and one "U" shaped arm is utilized to engage the columnar sleeve. In such configurations, no opposing "U" shaped arm arising from another "L" shaped bracket is available to oppose, and thus stabilize, the position of the "U" shaped arm arising from the single base plate. Use of a proximal and distal set of washers and nuts to stabilize the "U" shaped arm enables the arm to be drawn proximally, towards the vertical portion of the base plate via tightening of the inner (more proximal nut), so as to firmly engage the cylindrical sleeve. After the sleeve is so engaged, tightening of the distal set of washers and nuts, proximally towards the outer face of the vertical plate, tends to further stabilize the "U" shaped arms.

In the embodiment of the present invention illustrated in FIG. 5, two brackets are utilized to secure the floating dock 5 to an inboard mooring pole 7. Each of the brackets illustrated in FIGS. 1, 2, 4 and 5 includes an "L" shaped base plate (1 & 3) each of which utilizes two "U" shaped arms (81, 81' and 80, 80') to engage and anchor the floating dock to a mooring pole. More specifically, the floating dock includes pile aperture 18 through which pile 7 extends. On opposing sides of the aperture, bores are prepared 115 for receipt of anchoring bolts 114 which are utilized to affix the bottom surface of the horizontal portion 28 of the "L" shaped brackets to opposing sides of the pile aperture. As shown in the figure, anchoring the "L" shaped brackets in this manner also provides strengthening of the top decking of the floating dock by tying together portions of the decking 114 comprising the top surface of the floating dock which are cut to form the aperture.

Figure 2:
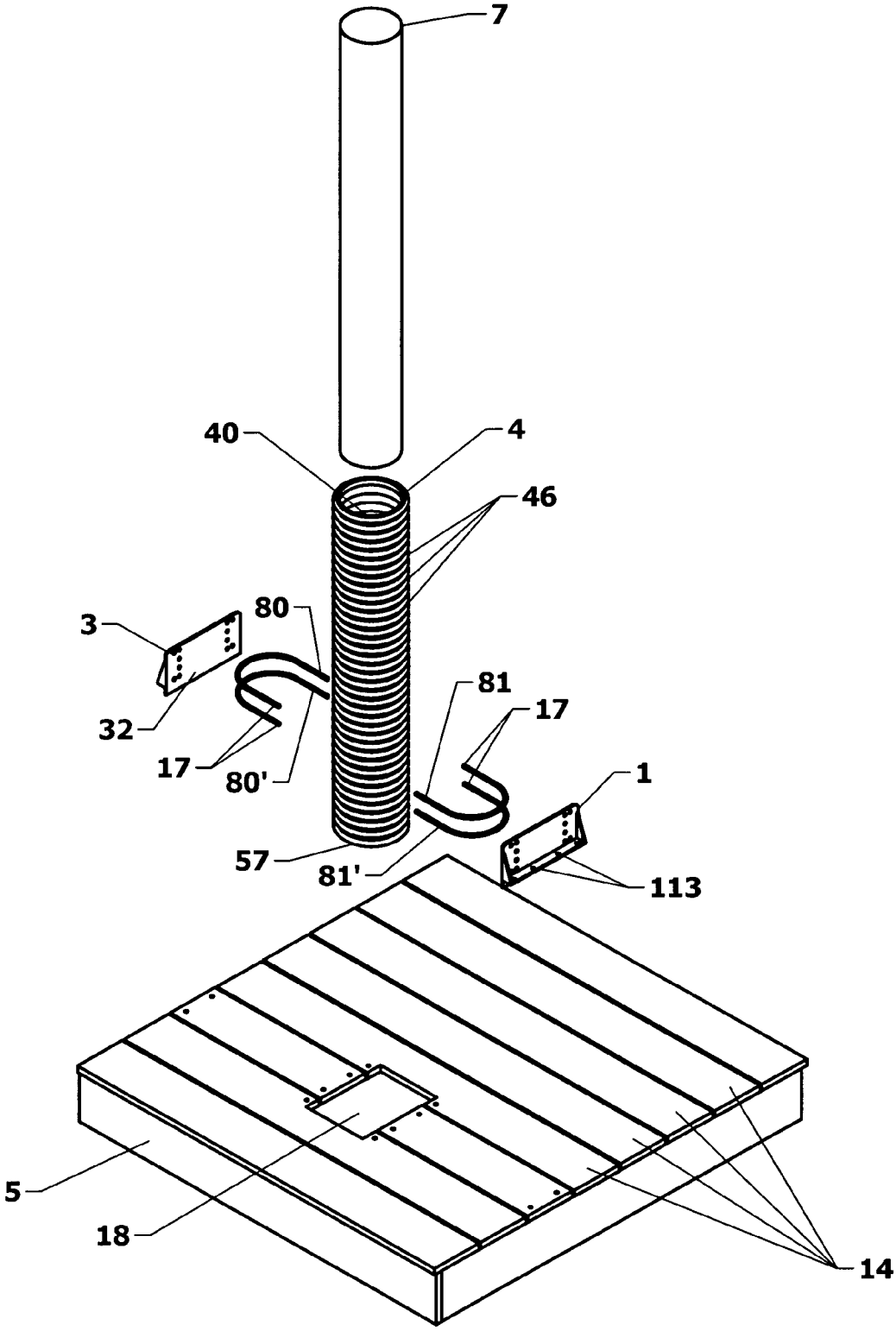
FIG. 2 is an isometric exploded view of the embodiment of the present invention illustrated in FIG. 1.

As shown in FIGS. 1, 2 and 5, the columnar sleeve 4 is coaxially placed upon the pile as described above. The curved, semi-circular inner portion 91 of each of the 4 "U" shaped arms 80, 80', 81, and 81' is placed within so as to engage selected circumferential grooves 46 formed in the outer surface of the columnar sleeve. Thereafter, the two termini 17 of each of the "U" shaped arms is introduced through a pair of "U" shaped arm receiving holes (90/90', 92/92', 94/94' & 96/96) provided within the vertical portion of the "L" shaped base plate. As illustrated in the figures, preferred embodiments of the present invention include "U: shaped arms which are shaped and configured to include external threading adjacent to and extending to each of said termini. As described above, each pair of "U" shaped arm receiving holes is prepared so that a line connecting the center of each hole of a give pair is parallel to the horizontal portion of the mounting plate, the top surface of the floating dock to which the base plate is anchored, as well as parallel to a line connecting each member of all other "U" shaped arm receiving holes prepared in the vertical portion of the plate. Each circumferential groove 46 of the columnar sleeve selected for engagement by an "L" shaped arm is selected so that the termini of said arm can be aligned with a pair of receiving holes (90/90', 92/92', 94/94' & 96/96) of the base plates. As shown in FIG. 1, it may be advantageous, in embodiments of the present invention utilizing two brackets—each including two "L" shaped arms—, that a "staggered" pattern of engagement be utilized for affixing the base plates to the circumferential grooves of the columnar sleeve. More specifically, and, as shown in FIG. 1, the superior most "U" shaped arm 80, extending from "L" shaped base plate 1 directly (and horizontally) overlies "U" shaped arm 81 which extends from opposing "L" shaped base plate 3 which overlies and is horizontal to U" shaped arm 80' which extends from base plate 1. Finally, inferior most "U" shaped bracket 81' extends from base plate 3. This staggered arrangement of "L" shaped arm positioning promotes an even application of force applied to the columnar sleeve from each bracket after adjustment thereof (as described above). However, the present invention also contemplates no staggered placement of "L" shaped arms.

Figure 3:
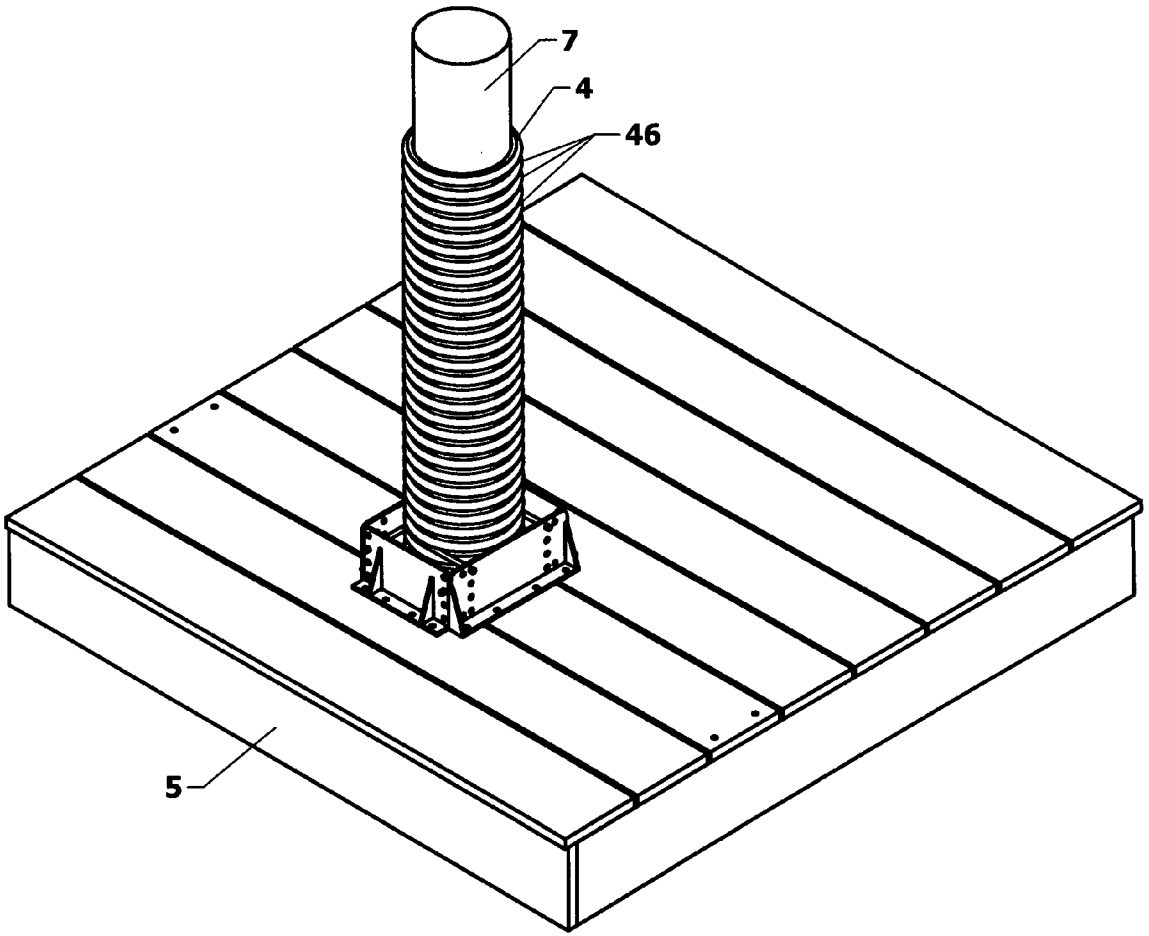
FIG. 3. is an isometric view of the apparatus of the present invention affixing a mooring pile to a floating dock utilizing four base plates.

As mentioned above, the present invention contemplates embodiments that utilize one or more brackets. When one bracket is utilized, it is highly desired that the single "L" shaped or flat base plate utilized engage at least two adjacent or non-adjacent circumferential grooves of the columnar sleeve via use of two "U" shaped arms affixed thereto. In embodiments of the present invention utilizing three or four (as shown in FIG. 3), each "L" shaped bracket may engage the columnar sleeve with one or more "U" shaped arms, the use of one such arm per base plate providing sufficient engagement and stabilization of the floating dock to an inboard mooring pile.

As shown in FIG. 4, certain preferred embodiments of the present invention engage two or more inboard piles for stabilization and mooring of a floating dock. In such embodiments, each such inboard pile extends through the top surface of the floating dock through its own pile aperture 18. In such embodiments, at least one "L" shaped bracket is affixed to the top surface of the dock in the manner described above. The number and position of "U" shaped arms extending from such brackets is selected in accordance with user preferences and stability issues. For example, in regard to embodiments of the present invention wherein two or more inboard piles are engaged (as shown in FIG. 4) or embodiments wherein a single inboard pile is utilized to moore a floating dock, it is found that utilizing two or more "L" shaped brackets for engagement of the columnar sleeve provides greater stability of the dock—resistance to listing—as opposed to the use of a single "L" shaped base plates (with one or more "U" shaped arms extending therefrom. In regard to embodiments utilizing two "L" shaped base plates to engage a mooring pile (via circumferential grooves of the columnar sleeve coaxially placed thereupon), it is found that utilizing two "L" shaped arms (rather than one) extending from each base plate for engagement of a selected circumferential groove provides more stability to the floating dock. Also, it is found that engaging two, rather than one inboard pile will provide greater stability for a floating dock then one pile alone. However, the present invention contemplates embodiments in which a floating dock engages but a single inboard pile as discussed above.

As discussed above, the central bore 40 of the columnar sleeve 4 is especially configured to demonstrate a diameter sufficient to allow the bore to receive (and the sleeve to be place coaxially upon) and closely adapt to a piling having a given outside diameter and length. The term "closely adapt" as utilized in regard to the coaxial fit of the sleeve upon a mooring pole refers to a relatively close adaptations of sleeve upon pile—so as to minimize lateral displacement of the sleeve away from the pile while, at the same time, providing sufficient clearance for movement—without binding—of the sleeve along the length of the pile. Such a configuration allows the cylindrical sleeve, as discussed above and below, to be coaxially slipped over a mooring pile adjacent to a floating dock and move up and down the pile with little lateral displacement from the long axis of the pile. It is preferred that, in order to achieve such close adaptation of sleeve to pile, that the inside diameter of the cylindrical sleeve be from about 1.0 inches to about 4 inches larger than the outside diameter of a pile to which it is applied. It is still further preferred that the inside diameter of the cylindrical sleeve be from about 1.5 inches to about 3 inches larger than the outside diameter of the cylindrical sleeve. The outside surface of the cylindrical sleeve is configured to include a plurality of circumferential parallel rings and grooves 46. Thus, the circumferential parallel rings and grooves are oriented perpendicular to the long axis of the sleeve. It is especially advantageous to configure the cylindrical sleeves with parallel grooves running along the entire length of the cylindrical sleeve.

In contrast to the outside surface, the inner surface of the cylindrical sleeve (defining the central bore), exhibits a smooth surface to facilitate movement along the length of a mooring pile. The cylindrical sleeve may be fabricated of any marine quality material such as, for example, a polyvinyl, polyether or polyester plastic. The sleeve may be also fabricated from a natural rubber or a synthetic rubber such as, for example, a nitrile rubber.

In certain preferred embodiments of the present invention the apparatus further comprises a buoyant base 48, including a superior (distal) 49 and inferior (proximal) 50 terminus affixed to the cylindrical sleeve. The buoyant base can be further described as having a outer surface 51 as well as an inner core. The inner core is filled with a buoyant material, and includes a central bore 54. The outer surface 51 of the buoyant base is advantageously covered by a tough resilient cover suitable for marine use. Suitable materials for such a resilient cover include, for example, polyvinyl, polyester or nylon plastics as well as natural rubber or nitrile rubber compositions. Both the superior and inferior terminus of the buoyant base include a central opening contiguous with the central bore 54.

In embodiments of the present invention incorporating a buoyant base, the inner bore of the buoyant base is sized so as to enable the base to be receive and be affixed to the outside surface of the sleeve. Therefore it is especially advantageous that the diameter of inner bore of the buoyant base and the outside diameter of the columnar sleeve be configured so that a proximal portion of the outer surface of the cylindrical sleeve will fit coaxially within and mate with the central bore of the buoyant base. Such a configuration allows ease of fixation of the buoyant base to the proximal terminus of the cylindrical tube via, for example, injection and curing of polystyrene core material into the base during fabrication of the device or any other desired means such as the use of adhesives, metal or plastic fasteners.

In embodiments of the present invention wherein the device includes a buoyant base affixed to the columnar sleeve adjacent to the inferior (or proximal) terminus of the sleeve, the sleeve is placed so that the buoyant base underlies the top decking or, in other embodiments, the structural framing of the dock, adjacent to and underling the pile aperture. In this manner, the buoyant base engages either the top decking or the underlying framing of the floating dock and provides additional buoyancy thereto. In such embodiments incorporating a buoyant base, the inferior terminus 57 of the cylindrical sleeve may be drawn past (further inferior to) the inferior terminus of the buoyant base if so desired for a particular mounting application. As mentioned above, the inner coil of the buoyant base surrounds and forms the central bore of the base.

In preferred embodiments of the present invention, the buoyant material utilized to provide buoyancy to the buoyant base and, in certain embodiments, to fill the core and space between the rings and grooves of the cylindrical sleeve and inner coil demonstrate, at minimum, sufficient buoyancy so as to assure that the entire length of cylindrical sleeve, superior to the superior terminus of the buoyant base, will be above the water line when the device is placed on a mooring pole —both prior and after affixing the apparatus to a dock—. Providing such buoyancy is necessary in order to expose all of the circumferential grooves on the cylindrical sleeve, superior to the buoyant base, above the water line for the most flexible positioning options. However, it is still further preferred that the base demonstrate sufficient buoyancy so as to provide the overlying dock with buoyancy beyond that which the dock otherwise may demonstrate and sufficient buoyancy to enable the dock to withstand submergence when bearing the weight expected and appropriate to the docks usual application.

The cylindrical sleeve may be fabricated of any marine quality material such as, for example, an ABS, polyvinyl, polyether, polyurethane, polypropylene, polyolefin, or polyester plastic. The sleeve may be also fabricated from a natural rubber or a synthetic rubber such as, for example, a nitrile rubber compound. The smooth inner surface of the cylindrical sleeve (and the central bore defined thereby) are especially sized and configured so as to allow the device (in embodiments of the present invention with and without a buoyant base affixed to the cylindrical sleeve) to slide easily over a mooring pole 7 without causing any damage thereto. The smooth inner surface of the cylindrical sleeve runs from the inferior 57 (or proximal) to the superior 49 (or distal) terminus of the device thereby allowing the entire device to be placed upon and slide up and down a mooring pole.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. An apparatus for affixing a floating dock to an inboard mooring pile comprised of:

a cylindrical sleeve, a mooring bracket and a means for affixing the mooring bracket to a floating dock adjacent to a pile aperture formed within a top surface of the floating dock the cylindrical sleeve is a tubular structure having a superior terminus, an inferior terminus, a length, an outer surface, an outside diameter, an inside diameter and an inner surface surrounding a central bore, wherein the inner surface of said sleeve has a substantially smooth contour and the inside diameter is selected to enable the sleeve to be placed coaxially upon and closely adapt to a mooring pile of a given outside diameter while enabling said cylindrical sleeve to move up and down along said pile without binding thereto and wherein the outer surface of the sleeve is configured to include a contour demonstrating a plurality of parallel circumferential rings, said rings, in turn, defining parallel circumferential grooves therebetween, and the mooring bracket is comprised of:

at least one base plate including at least one pair of "U" shaped arm receiving holes and at least two anchor bolt receiving holes, the mooring bracket further comprising at least one "U" shaped arm especially shaped and configured to include a semi-circular portion for mating engagement with a selected circumferential groove of the columnar sleeve and the at least one "U" shaped arm also including two termini especially configured and adapted for affixation of the at least one "U" shaped arm to the at least one base plate at the at least one pair of "U" shaped arm receiving holes, wherein, when the base plate is affixed to a floating dock adjacent to a pile aperture through which a mooring pile extends, and the semi-circular portion of the at least one "U" shaped arm is positioned within so as to engage a selected groove of a cylindrical sleeve coaxially placed upon the mooring pile, the two termini of the "U" shaped arm can be aligned with, engage and affixed to the base plate at the at least one pair of "U" shaped arm receiving holes whereby the "U" shaped arm is held in a position parallel to the top surface of the floating dock and firmly engages the selected groove of the cylindrical sleeve.

2. The apparatus of claim 1 wherein a portion of the at least one "U" shaped arm, adjacent to each of the two termini thereof, are especially shaped and configured to include external threading and wherein the termini include an external diameter that enables said termini to pass through the at least one pair of "U" shaped arm receiving holes formed in the base plate and thereafter be affixed to said base plate by means of engaging said externally threaded portion of the "U" shaped arm adjacent to each of the termini with a nut which is formed and configured to matingly engage said threading.

3. The apparatus of claim 2 wherein the at least one "U" shaped arms is affixed to the base plate by matingly engaging the threaded portion of the "U" shaped arm adjacent to each of the termini thereof with a nut configured to matingly engage said threading prior to passing said termini through a pair of "U" shaped arm receiving holes and thereafter matingly engaging each of said termini with an additional nut so as to provide enhanced stabilization and affixation of the "U" shaped arm to the base plate.

4. The apparatus of claim 1 wherein the at least one "U" shaped arm is affixed to the base plate by means of welding.

5. The apparatus of claim 1 wherein the base plate is affixed to the top surface of a dock by means of steel fasteners.

6. The apparatus of claim 1 wherein the steel fasteners are selected from the group consisting of nails, screws, machine bolts, lag bolts and "U" bolts.

7. The apparatus of claim 6 wherein the steel fasteners are fabricated from a corrosion resistant material.

8. The apparatus of claim 7 wherein the corrosion resistant material is selected from the group consisting of brass, stainless steel and galvanized steel.

9. The apparatus of claim 1 wherein the base plate is fabricated from a corrosion resistant material.

10. The apparatus of claim 9 wherein the corrosion resistant material is selected from the group consisting of stainless steel, brass, galvanized steel, composite plastic and fiberglass.

11. The apparatus of claim 1 wherein the "U" shaped arm is fabricated from a corrosion resistant material.

12. The apparatus of claim 11 wherein the corrosion resistant material is selected from the group consisting of brass, stainless steel and galvanized steel.

13. The apparatus of claim 1 wherein the base plate is an "L" shaped base plate having a vertical portion and a horizontal portion and wherein the at least one "U" shaped arm is affixed to the base plate by locating and affixing each of the termini of the at least one "U" shaped arm to a pair of "U" shaped arm receiving holes located within the vertical portion of the "L" shaped base plate.

14. The apparatus of claim 13 wherein two "U" shaped arms are mounted upon the vertical portion of the at least one base plate, the circumferential portion of each of said "U" shaped arms engaging a selected circumferential groove of the cylindrical sleeve.

15. The apparatus of claim 1 wherein the apparatus includes two "L" shaped base plates, at least one "U" shaped arm being mounted upon the vertical portion of each of said "L" shaped base plates and each of said at least one "U" shaped arms enabling engagement of a selected circumferential groove of the cylindrical sleeve.

16. The apparatus of claim 1 wherein the apparatus includes four "L" shaped base plates, at least one "U" shaped arm being mounted upon the vertical portion of each of said "L" shaped base plates and each of said at least one "U" shaped arms enabling engagement of a selected circumferential groove of the cylindrical sleeve.

17. The apparatus of claim 1 wherein the base plate is configured as a flat plate having at least one pair of "U" shaped arm receiving holes.

18. The apparatus of claim 17 wherein the flat plate base plate further includes at least two anchor bolt receiving holes for receipt and affixation of a fixation means.

19. The apparatus of claim 17 wherein said affixation means comprises a steel fastener.

20. The apparatus of claim 17 wherein the flat plate base plate is bonded directly to the floating dock adjacent to the pile aperture.

21. The apparatus of claim 17 wherein the flat plate base plate is formed as an integral part of the floating dock adjacent to the pile aperture.

22. The apparatus of claim 1 wherein said apparatus further comprises a buoyant base, said buoyant base including an outer surface, an inner surface surrounding a central bore, a superior terminus, an inferior terminus and a core and wherein said central bore demonstrates an inside diameter especially configured to enable a portion of the cylindrical sleeve, adjacent to an inferior terminus thereof, to be inserted within said bore and wherein said core is filled with a buoyant material having a specific gravity less than that of water and providing sufficient buoyancy to the apparatus so as to enable an entire length of the cylindrical sleeve, superior to the superior terminus of the buoyant base, to lie above a water line and also so as to provide buoyancy to the floating dock.

23. An apparatus for affixing a floating dock to an inboard mooring pile comprised of:

a cylindrical sleeve, a mooring bracket and a means for affixing the mooring bracket to a floating dock wherein the cylindrical sleeve is a tubular structure having a superior terminus, an inferior terminus, a length, an outer surface, an outside diameter, an inside diameter and an inner surface surrounding a central bore, wherein the inner surface of said sleeve has a substantially smooth contour and the inside diameter is selected to enable the sleeve to be placed coaxially upon and closely adapt to a mooring pile of a given outside diameter while enabling said cylindrical sleeve to move up and down along said pile without binding thereto and wherein the outer surface of the sleeve is configured to include a contour demonstrating a plurality of parallel circumferential rings, said rings, in turn, defining parallel circumferential grooves therebetween, and the mooring bracket is comprised of:

at least two elongated rods, said rods having a longitudinal axis, a length, two termini and an outside diameter, the outside diameter of said at least two rods being selected so as to enable each of the at least two rods to be placed within closely adapt to, and firmly engage a selected circumferential groove of the cylindrical sleeve, said mooring bracket further including a means for affixing the at least two rods to a floating dock adjacent to a pile aperture therein in such a manner wherein the longitudinal axis of each of said rods is oriented in a parallel relation with a top surface of the floating dock while said rods are also affixed to the floating dock, in such a position, so as to enable each such rod to firmly engage a portion of a selected circumferential groove of the cylindrical sleeve, wherefore, when the at least two elongated rods so engage a selected circumferential groove of a cylindrical sleeve coaxially placed about an inboard piling set beneath and which extends through a pile aperture of a floating dock, the close adaptation and firm engagement of said at least two elongated rods with a portion of a selected circumferential groove of the cylindrical sleeve provides stabile mooring of the floating dock to the inboard pile and resistance against listing of the dock in reaction to disturbance of water in which the dock is positioned.

24. The apparatus of claim 23 wherein each termini of the at least two elongated rods is especially configured and adapted to enable affixation of each of said termini to a vertical portion of an "L" shaped base plate which, in turn, is affixed to the floating dock adjacent to the pile aperture, the "L" shaped base plate and affixation of the elongated bars thereto being the means of affixing the at least two rods to a floating dock adjacent to a pile aperture.

25. The apparatus of claim 23 wherein each termini of the at least two elongated rods is especially configured and adapted to enable affixation of each of said termini to a flat base plate which, in turn, is affixed to selected sides of the pile aperture.

26. The apparatus of claim 23 wherein the means for affixing the at least two elongated rods to a floating dock comprises receiving holes prepared within the floating dock adjacent to the pile aperture thereof and a fastener for affixing the termini of said elongated rods to said receiving holes.

27. The apparatus of claim 26 wherein a portion of each of the elongated rods adjacent to the termini thereof includes external threading and said elongated rods include an outside diameter that enable a portion of the rods, adjacent to the termini thereof, to extend through receiving holes formed in the floating deck adjacent to the pile aperture and wherein said apparatus further includes a nut which includes threading especially shaped and configured to engage the threaded portion of each portion of the elongated rods, adjacent to the termini thereof, extending through said receiving holes so as to provide said means of affixing said elongated rods to the floating dock.

28. The apparatus of claim 23 wherein the termini of the elongated rods are affixed to a floating dock by means of bonding.

29. The apparatus of claim 23 wherein the termini of the elongated rods are affixed to a floating dock my means of welding.

* * * * *